US011378909B2

(12) United States Patent
Sueshige et al.

(10) Patent No.: US 11,378,909 B2
(45) Date of Patent: Jul. 5, 2022

(54) IMAGE FORMING APPARATUS AND IMAGE FORMING UNIT

(71) Applicant: CANON KABUSHIKI KAISHA, Tokyo (JP)

(72) Inventors: Kazutaka Sueshige, Susono (JP); Tatsuro Harada, Mishima (JP); Takayuki Yada, Suntou-gun (JP); Akinobu Hirayama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/201,148

(22) Filed: Mar. 15, 2021

(65) Prior Publication Data

US 2021/0216034 A1 Jul. 15, 2021

Related U.S. Application Data

(63) Continuation of application No. 16/798,618, filed on Feb. 24, 2020, now Pat. No. 10,983,475.

(30) Foreign Application Priority Data

Feb. 25, 2019 (JP) ..... JP2019-032129
Oct. 16, 2019 (JP) ..... JP2019-189732

(51) Int. Cl.

| | |
|---|---|
| ***G03G 21/16*** | (2006.01) |
| ***G03G 21/00*** | (2006.01) |
| ***G03G 21/10*** | (2006.01) |
| ***G03G 21/18*** | (2006.01) |

(52) U.S. Cl.

CPC ..... *G03G 21/1647* (2013.01); *G03G 21/0005* (2013.01); *G03G 21/105* (2013.01); *G03G 21/186* (2013.01)

(58) Field of Classification Search

CPC ..... G03G 21/0005; G03G 21/105; G03G 21/1647; G03G 21/1825; G03G 21/186

See application file for complete search history.

(56) References Cited

U.S. PATENT DOCUMENTS

| | | | |
|---|---|---|---|
| 2008/0138109 | A1 | 6/2008 | Anan et al. |
| 2009/0257781 | A1 | 10/2009 | Fuji |
| 2010/0080615 | A1 | 4/2010 | Kikuchi |
| 2011/0164897 | A1 | 7/2011 | Kikuchi |
| 2016/0070207 | A1 | 3/2016 | Yada et al. |
| 2016/0154374 | A1 | 6/2016 | Hiramatsu et al. |
| 2017/0108824 | A1 | 4/2017 | Kawakami et al. |
| 2017/0248869 | A1 | 8/2017 | Matsumoto et al. |
| 2017/0248905 | A1 | 8/2017 | Anan et al. |

(Continued)

FOREIGN PATENT DOCUMENTS

| | | |
|---|---|---|
| JP | 2002-196585 A | 7/2002 |
| JP | 2009-157389 A | 7/2009 |
| JP | 2010-102285 A | 5/2010 |

*Primary Examiner* — Sophia S Chen
(74) *Attorney, Agent, or Firm* — Venable LLP

(57) ABSTRACT

An image forming unit to be attached to an apparatus body of an image forming apparatus includes a first cartridge including a driven portion configured to rotate on a first rotational axis; and a second cartridge configured separable from the first cartridge. The second cartridge includes an input portion configured to receive driving force from the apparatus body; and a drive transmission portion configured to rotate on a second rotational axis and to transmit the driving force to the driven portion.

13 Claims, 36 Drawing Sheets

(56) References Cited

U.S. PATENT DOCUMENTS

| | | | | |
|---|---|---|---|---|
| 2017/0261917 | A1 | 9/2017 | Harada et al. | |
| 2017/0329279 | A1 | 11/2017 | Hirayama et al. | |
| 2018/0267455 | A1 | 9/2018 | Isaka | |
| 2018/0329359 | A1 | 11/2018 | Anan et al. | |
| 2018/0348700 | A1 | 12/2018 | Hirayama et al. | |
| 2019/0179256 | A1 | 6/2019 | Hirayama et al. | |
| 2019/0361383 | A1* | 11/2019 | Sato | G03G 21/105 |
| 2020/0050143 | A1 | 2/2020 | Hirayama et al. | |
| 2020/0089159 | A1 | 3/2020 | Sato et al. | |
| 2020/0150582 | A1 | 5/2020 | Hirayama et al. | |
| 2020/0201245 | A1 | 6/2020 | Hirayama et al. | |
| 2020/0201246 | A1 | 6/2020 | Hirayama et al. | |
| 2020/0201247 | A1 | 6/2020 | Hirayama et al. | |
| 2020/0201248 | A1 | 6/2020 | Hirayama et al. | |
| 2020/0201249 | A1 | 6/2020 | Hirayama et al. | |
| 2020/0241468 | A1 | 7/2020 | Hirayama et al. | |
| 2020/0272087 | A1 | 8/2020 | Sueshige et al. | |

* cited by examiner

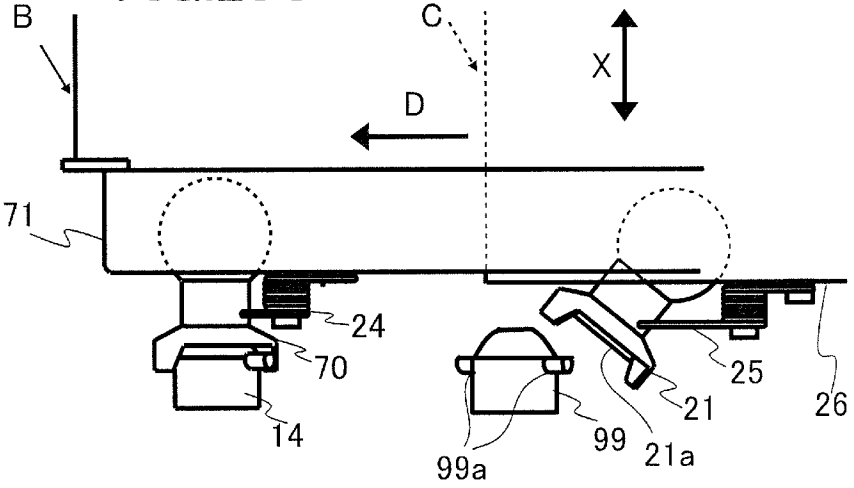
FIG.23A
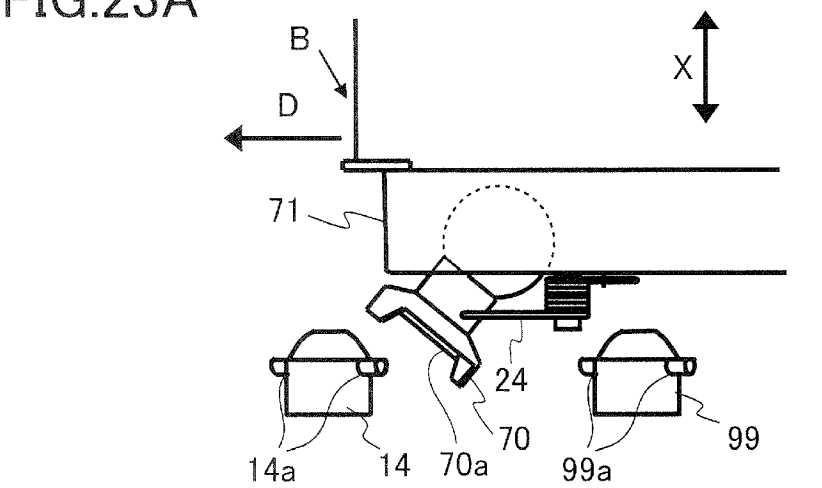
FIG.23B
FIG.23C
FIG.23D

IMAGE FORMING APPARATUS AND IMAGE FORMING UNIT

BACKGROUND OF THE INVENTION

Field of the Invention

The present invention relates to an image forming apparatus for forming an image on a recording medium, and an image forming unit used in the image forming apparatus.

Description of the Related Art

Heretofore, an image forming apparatus that adopts an electrophotographic system has been disclosed, in which a member for performing an electrophotographic process is arranged in a cartridge that can be attached to and detached from the apparatus body, so that a user or a maintenance operator can perform replacement operations easily and usability is improved thereby. Japanese Patent Application Laid-Open Publication No. 2009-157389 discloses a configuration where a process cartridge including a photosensitive drum and a developing roller is attached to a tray that can be drawn out of an apparatus body, and by inserting the tray to the apparatus body, the process cartridge can be attached to the apparatus body. Meanwhile, there are photosensor units equipped with a waste toner conveyance member for conveying waste toner that has not been transferred to a photosensitive member. Japanese Patent Application Laid-Open Publication No. 2002-196585 discloses a configuration in which a developing unit uses driving force received from the apparatus body to drive the waste toner conveyance member of a cleaning unit.

According to the configuration disclosed in the above-described document, the cleaning unit equipped with the photosensitive drum and the developing unit equipped with the developing roller are arranged in a single cartridge.

SUMMARY OF THE INVENTION

The present invention provides an image forming unit, in which a second cartridge is arranged detachably from a first cartridge and in which driving force can be transmitted from the second cartridge to the first cartridge, and an image forming apparatus including the image forming unit.

According to one aspect of the invention, an image forming unit to be attached to an apparatus body of an image forming apparatus includes: a first cartridge including a driven portion configured to rotate on a first rotational axis; and a second cartridge configured separable from the first cartridge, the second cartridge including: an input portion configured to receive driving force from the apparatus body; and a drive transmission portion configured to rotate on a second rotational axis and to transmit the driving force to the driven portion.

Further features of the present invention will become apparent from the following description of exemplary embodiments with reference to the attached drawings.

BRIEF DESCRIPTION OF THE DRAWINGS

FIG. 23A is a view illustrating a step of establishing a drive connection of the process unit and the apparatus body according to the first embodiment.

FIG. 23B is a view illustrating a step of establishing the drive connection of the process unit and the apparatus body according to the first embodiment.

FIG. 23C is a view illustrating a step of establishing the drive connection of the process unit and the apparatus body according to the first embodiment.

FIG. 23D is a view illustrating a step of establishing the drive connection of the process unit and the apparatus body according to the first embodiment.

DESCRIPTION OF THE EMBODIMENTS

Now, embodiments for carrying out the present invention will be described with reference to the drawings.

Examples of image forming apparatuses in the following description include copying machines, printers, multifunction devices, commercial printing devices and so on. Image is formed on a recording medium based on image information entered from an external computer or image information read from documents. Various types of sheet material of various materials and shapes can be used, such as normal paper and thick paper, plastic films, coated paper, special-shaped sheets such as envelopes and index sheets, and cloth.

First Embodiment

Figure 1:
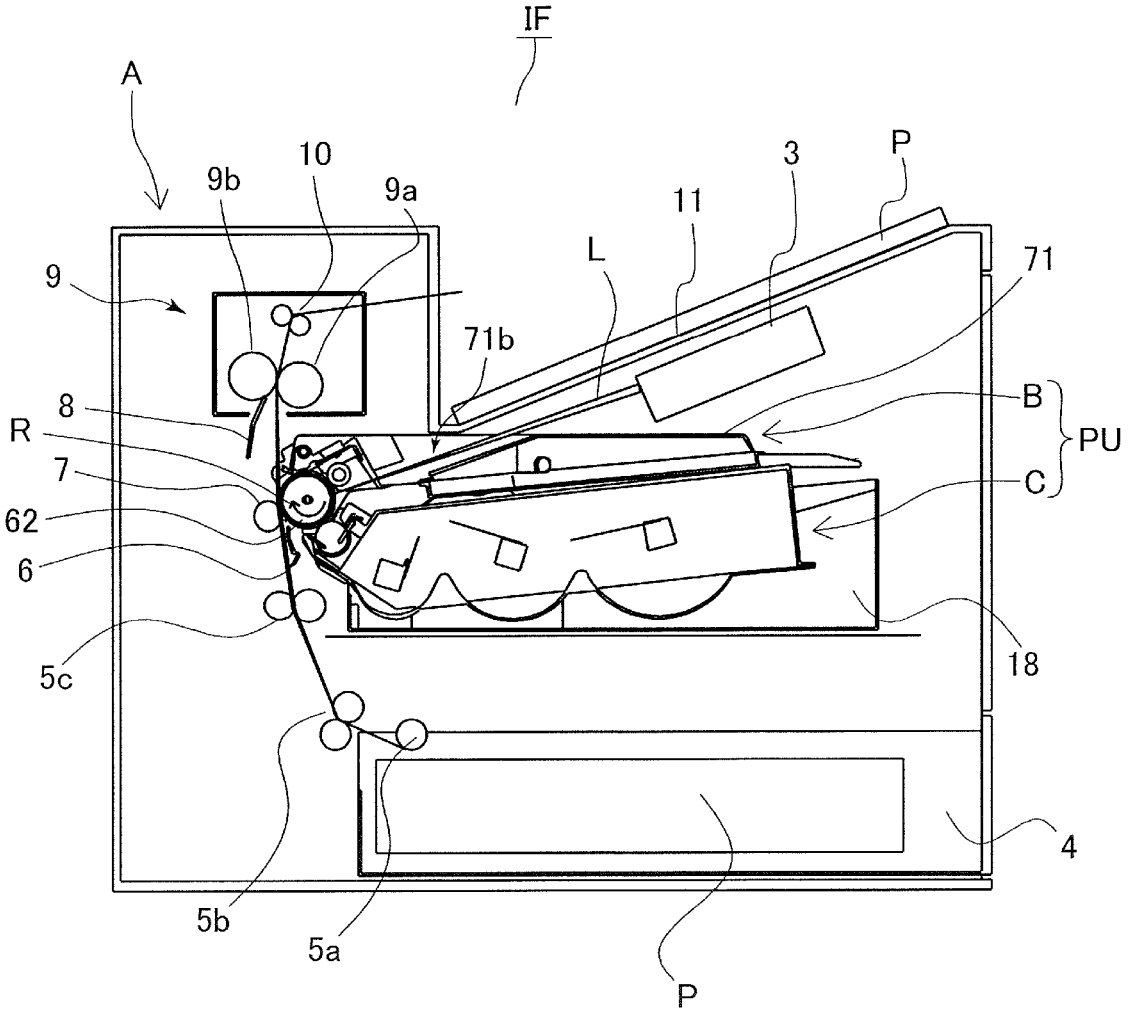
FIG. 1 is a schematic drawing of an image forming apparatus according to a first embodiment.
Figure 2:
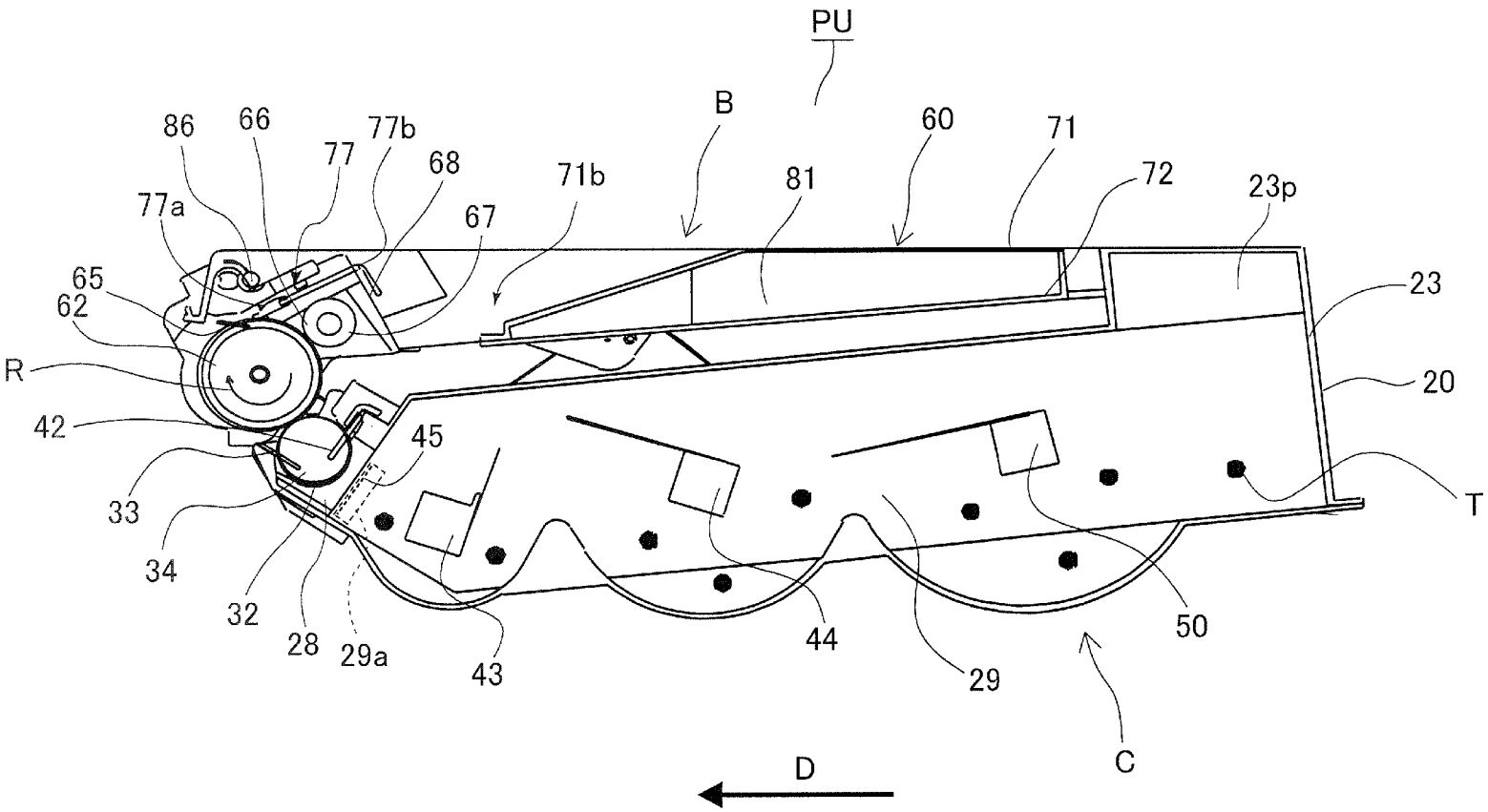
FIG. 2 is a schematic drawing of an image forming unit according to the first embodiment.

An image forming apparatus according to a first embodiment will be described. FIG. 1 is a schematic drawing illustrating a cross-sectional configuration of an image forming apparatus IF according to the present embodiment, and FIG. 2 is a schematic drawing of a photoconductor cartridge B and a developing cartridge C. As illustrated in FIG. 1, the photoconductor cartridge B and the developing cartridge C are attached to an apparatus body A of the image forming apparatus IF, forming a process unit PU in which an image is formed on a sheet P serving as a recording medium. The apparatus body A refers to the portion of the image forming apparatus IF excluding the photoconductor cartridge B and the developing cartridge C, and it includes a metal frame constituting a frame body of the image forming apparatus IF and an exterior cover constituting the surface of the casing.

The process unit PU is an image forming unit according to the present embodiment that can be attached to and detached from the apparatus body of the image forming apparatus. Further, the photoconductor cartridge B is a first cartridge according to the present embodiment, and the developing cartridge C is a second cartridge according to the present embodiment.

General Configuration of Image Forming Apparatus

As illustrated in FIG. 1, the image forming apparatus IF according to the present embodiment is a laser beam printer that adopts an electrophotographic system in which an electrostatic latent image is formed on a surface of a photosensitive drum 62 using laser beam, and the image is developed using developer and transferred to a sheet P. The apparatus body A includes, in addition to the photoconductor cartridge B and the developing cartridge C, a laser scanner 3 serving as an exposing unit, a fixing unit 9 serving as a fixing portion, and a sheet tray 4 serving as a sheet supporting portion. Further, the apparatus body A includes, along a direction in which the sheet P is conveyed from the sheet tray 4, a pickup roller 5*a*, a feed roller pair 5*b*, a conveyance roller pair 5*c*, a transfer guide 6, a transfer roller 7, a conveyance guide 8, the fixing unit 9, a sheet discharge roller pair 10, and a sheet discharge tray 11.

As illustrated in FIG. 2, the photoconductor cartridge B includes the photosensitive drum 62, a charging roller 66 serving as a charging portion, and a cleaning member 77 serving as a cleaning unit. The photosensitive drum 62 serving as an image bearing member according to the present embodiment is a drum-shaped photoconductor. The developing cartridge C includes a developing roller 32 serving as a developer bearing member, a toner chamber 29 serving as a developer storage portion, and a toner supply chamber 28. The charging roller 66 that carries out a charging process, the developing roller 32 that carries out a developing process, the transfer roller 7 that carries out a transferring process, and the cleaning member 77 that carries out a cleaning process are all examples of a processing portion that performs processes to the photoconductor in the electrophotographic processing.

In a state where the image forming apparatus IF receives an instruction, i.e., print start signal, to start forming an image to the sheet P, the photosensitive drum 62 is driven to rotate at a predetermined peripheral speed, i.e., processing speed, in the direction of arrow R. The charging roller 66 to which bias voltage has been applied contacts an outer peripheral surface of the photosensitive drum 62 and charges a surface of the drum uniformly and evenly. The laser scanner 3 irradiates a laser beam L modulated based on the image information (refer to FIG. 1) to the photosensitive drum 62 through a laser opening 71*b* provided on the photoconductor cartridge B and forms an electrostatic latent image on the drum surface.

As illustrated in FIG. 2, developer stored in the toner chamber 29 in the developing cartridge C is sequentially sent to the toner supply chamber 28. In the toner supply chamber 28, toner T is borne on the surface of the developing roller 32 by magnetic force of a magnet roller 34 arranged in the developing roller 32. Toner T that has reached a developing area where the developing roller 32 and the photosensitive drum 62 oppose to each other is transferred from the developing roller 32 to the drum surface according to a potential distribution on the surface of the photosensitive drum 62. Thereby, the electrostatic latent image on the drum surface is visualized as toner image.

In parallel with this process, feeding of sheet P is carried out at a synchronized timing with an exposing operation by the laser scanner 3. The pickup roller 5*a* illustrated in FIG. 1 contacts an uppermost sheet P on a sheet bundle supported on the sheet tray 4 and conveys the sheet P from the sheet tray 4. The feed roller pair 5*b* receives the sheet P from the pickup roller 5*a* and conveys the sheet to the conveyance roller pair 5*c* while separating the sheets one by one. The conveyance roller pair 5*c* conveys the sheet P to a transfer portion provided between the photosensitive drum 62 and the transfer roller 7 through the transfer guide 6. By having bias voltage applied to the transfer roller 7, the toner image borne on the photosensitive drum 62 is transferred to the sheet P at the transfer portion.

The sheet P to which toner image has been transferred is separated from the photosensitive drum 62 and conveyed to the fixing unit 9 along the conveyance guide 8. The fixing unit 9 includes a rotary member pair composed of a heating roller 9*a* and a pressure roller 9*b*, and a heat source, such as a halogen lamp, that heats the sheet P through the heating roller 9*a*. The fixing unit 9 applies heat and pressure to the toner image on the sheet while nipping and conveying the sheet P. Thereby, toner particles are melted and then adhered, by which the image is fixed to the sheet P. The sheet P having gone through the image fixing process is discharged by the sheet discharge roller pair 10 onto the sheet discharge tray 11 provided on an upper portion of the apparatus body A.

The cleaning member 77 removes foreign substances such as residual toner remaining on the photosensitive drum 62 that has not been transferred to the sheet P at the transfer portion. Thereby, the surface of the photosensitive drum 62 is cleaned to be prepared for the next image forming process.

Configuration of Cartridge of Process Unit

Next, a configuration of the process unit PU will be described. In the following description, a rotational axis direction, i.e., axial direction, of the photosensitive drum 62 and an axial direction of the developing roller 32 arranged in parallel therewith are referred to as a reference axis direction, in other words, longitudinal direction, of the photoconductor cartridge B and the developing cartridge C. In the reference axis direction, a side having a coupling for the photoconductor cartridge B and the developing cartridge C to receive driving force from the apparatus body A is referred to as a drive side of the photoconductor cartridge B and the developing cartridge C, and a side opposite therefrom is referred to as a non-drive side.

As illustrated in FIG. 2, a casing of the photoconductor cartridge B is composed of a cleaning frame member 71, and a lid member 72 fixed to the cleaning frame member 71 by a method such as welding. The cleaning frame member 71 supports the photosensitive drum 62 arranged at an opening portion thereof, and also supports the charging roller 66 and the cleaning member 77 in contact with the outer peripheral surface of the photosensitive drum 62. The above-described laser opening 71*b* is provided on the cleaning frame member 71 (also refer to FIG. 18). Further, the lid member 72 is a member that covers a lower portion of the cleaning frame member 71, and together with the cleaning frame member 71, it forms a space 81 that stores waste removed from the photosensitive drum 62 by the cleaning member 77. The main component of waste collected by the cleaning member 77 is waste toner that has not been transferred to the sheet at the transfer portion, and in addition thereto, paper dust and the like adhered to the photosensitive drum 62 from the sheet P are also collected.

Figure 19:
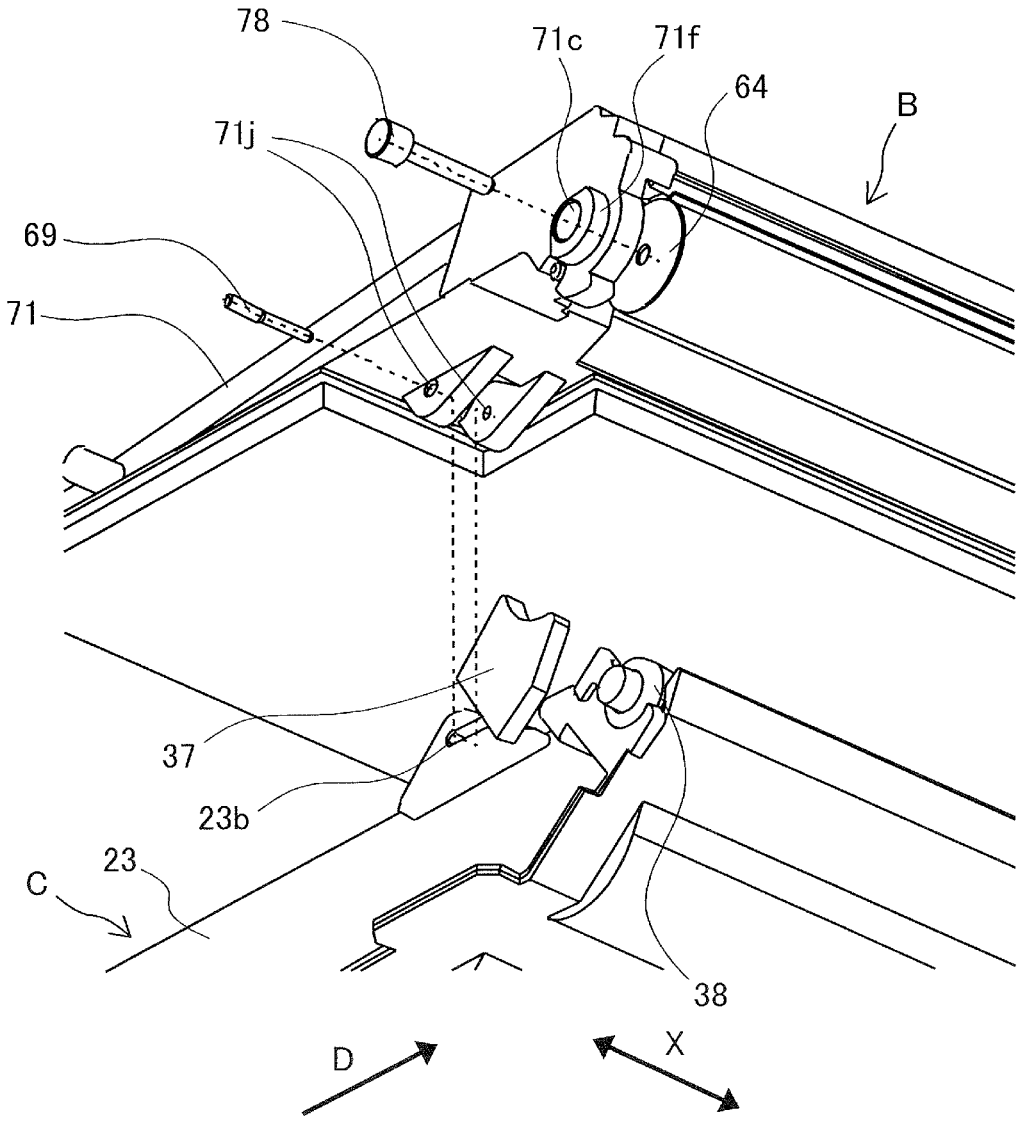
FIG. 19 is an exploded view of the process unit according to the first embodiment.
Figure 21:
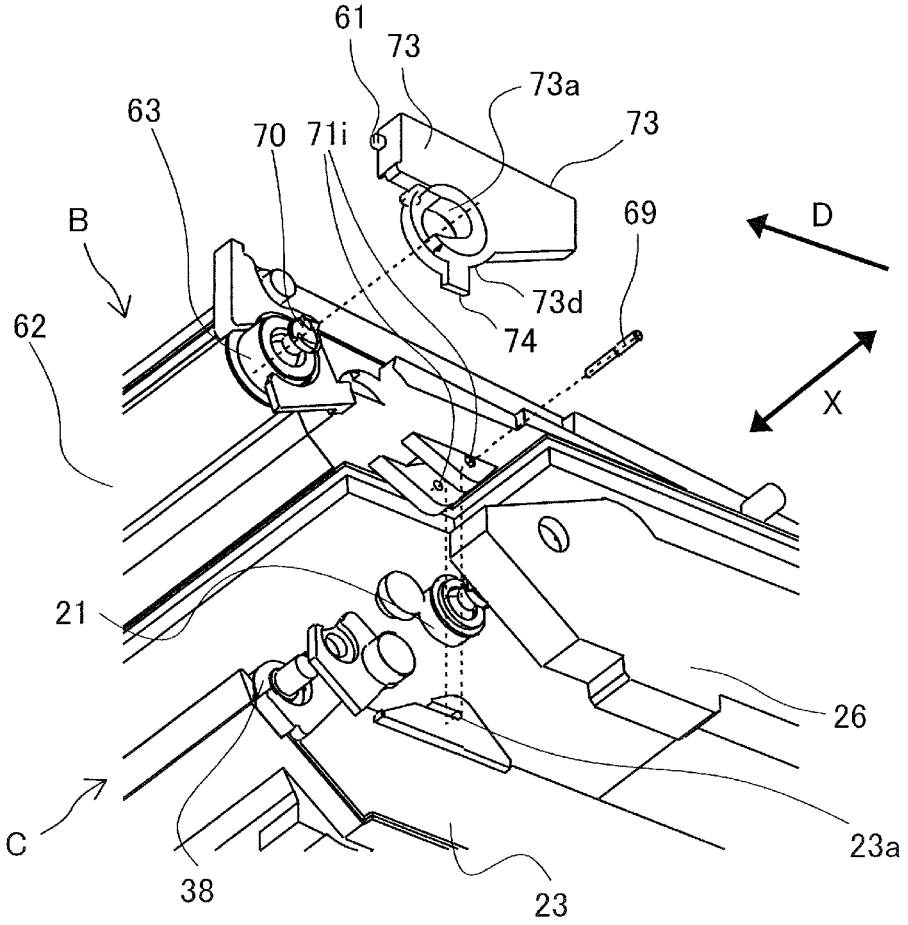
FIG. 21 is an exploded view of the process unit according to the first embodiment.

The photosensitive drum 62 has both ends thereof in the reference axis direction supported rotatably by the cleaning frame member 71, and it is configured to rotate in an arrow R direction in the drawing by receiving driving force from a drive motor (not shown) which serves as a driving source provided on the apparatus body A. Specifically, as illustrated in FIG. 21, on the drive side in the reference axis direction, a boss portion 63 provided at an end portion of the photosensitive drum 62 is rotatably fit to a hole portion 73*a* of a drum bearing 73 fixed to the cleaning frame member 71. Meanwhile, on the non-drive side, as illustrated in FIG. 19, a drum shaft 78 press-fit to a hole portion 71*c* provided on the cleaning frame member 71 fits to a hole portion provided on an end portion 64 of the non-drive side of the photosensitive drum 62 and rotatably supports the photosensitive drum 62.

The cleaning member 77 includes a cleaning blade 77*a* serving as a blade-shaped member formed of an elastic material such as rubber, and a support member 77*b* that supports the blade. The cleaning blade 77*a* is in contact with the photosensitive drum 62 in a counter direction with respect to the direction of rotation of the photosensitive drum 62. That is, the cleaning blade 77*a* is inclined with respect to a radial direction of the photosensitive drum 62 that passes the contact point with the drum surface so that a tip portion thereof is arranged upstream in the direction of rotation of the photosensitive drum 62 as it approaches the rotational axis of the photosensitive drum 62. Further, a drum contact sheet 65 for preventing leakage of waste toner from the cleaning frame member 71 is arranged at an edge of an opening portion of the cleaning frame member 71 to which the photosensitive drum 62 is arranged, so as to contact the photosensitive drum 62.

The charging roller 66 is rotatably supported at both end portions in the reference axis direction by the cleaning frame member 71 via a charging roller bearing 67. Further, the charging roller 66 is pressed against the photosensitive drum 62 by having the charging roller bearing 67 pressed toward the photosensitive drum 62 by an urging member 68. The charging roller 66 rotates along with the photosensitive drum 62. The portions (71, 72, 77) having excluded the photosensitive drum 62 and the charging roller 66 from the photoconductor cartridge B constitute a cleaning unit 60 whose main function is to clean the photosensitive drum 62.

The developing cartridge C includes the developing roller 32, the magnet roller 34, a developer container 23, a developing blade 42, and a roller contact sheet 33. The magnet roller 34 is arranged on an inner side of the developing roller 32, and it is fixed to the developer container 23. The developing blade 42 and the roller contact sheet 33 are arranged at an opening portion of the developer container 23 to which the developing roller 32 is arranged. The developing blade 42 regulates a layer thickness of toner T that is borne on the developing roller 32 and moves toward the developing area, and applies frictional charge to toner T. The roller contact sheet 33 prevents toner T in the toner supply chamber 28 from leaking to the exterior of the developing cartridge C.

The above-described toner chamber 29 and toner supply chamber 28 are formed on the inner side of the developer container 23. A first conveyance member 43, a second conveyance member 44 and a third conveyance member 50 are arranged in the toner chamber 29, and the respective conveyance members 43, 44 and 50 function as agitating members that agitate toner T, and convey the toner T toward the toner supply chamber 28 while agitating the same. The developer container 23 constitutes a casing 20 of the developing cartridge C together with a driven-side side member 26 (refer to FIG. 18) fixed to the drive side in the reference axis direction.

The developing roller 32 has both end portions thereof in the reference axis direction supported rotatably by bearing members 27 and 37 (refer to FIG. 18) fixed to the developer container 23. Further, a gap retainer 38 (refer to FIG. 18) that has a somewhat greater outer diameter than an outer diameter of the developing roller 32 is attached to both end portions of the developing roller 32. In a state where the gap retainer 38 contacts the outer peripheral surface of the photosensitive drum 62, a predetermined minute gap is maintained between the developing roller 32 and the photosensitive drum 62 in the developing area.

As illustrated in FIG. 2, an opening portion 29*a* (area denoted by dashed line) that allows the toner chamber 29 and the toner supply chamber 28 to be communicated is provided on the developer container 23. Before the developing cartridge C attached to the apparatus body A is used for the first time, the opening portion 29*a* is sealed by a sealing member 45, and toner T is sealed in the toner chamber 29. The sealing member 45 is a sheet-like member formed of a material such as polyethylene, wherein a first end side is welded to the developer container 23 at a periphery of the opening portion 29*a*, and a second end side is fixed to the first conveyance member 43. Then, in a state where the first conveyance member 43 rotates when the developing cartridge C is used for the first time, the sealing member 45 is wound up by the first conveyance member 43 while peeling the portion attached to the developer container 23. Thereby, the opening portion 29*a* is released, toner T flows into the toner supply chamber 28, and the developing roller 32 will be in a state capable of bearing toner T.

Attachment and Detachment of Cartridge

Figure 3:
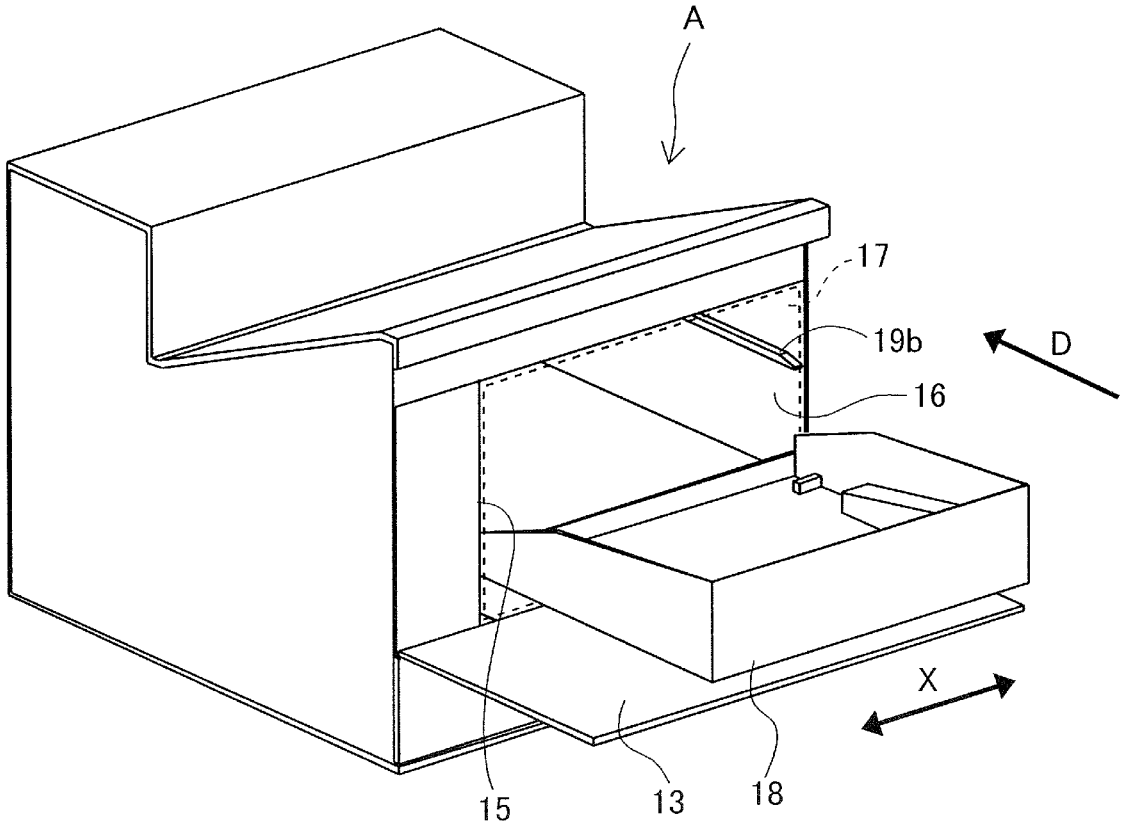
FIG. 3 is a perspective view of an apparatus body according to the first embodiment.

Next, a configuration for attaching and detaching the photoconductor cartridge B and the developing cartridge C to and from the apparatus body A will be described. FIG. 3 is a perspective view of the apparatus body A in a state where a door 13 is opened to allow attachment and detachment of the photoconductor cartridge B and the developing cartridge C. The door 13 is arranged pivotably on one side of the apparatus body A, and by opening the door 13, a cartridge insertion port 17 will be in an opened state. The photoconductor cartridge B and the developing cartridge C according to the present embodiment are attached to the apparatus body A by being inserted toward a direction of arrow D through the cartridge insertion port 17 serving as a common opening, and removed from the apparatus body A by being pulled out in a direction opposite thereto. The direction of arrow D in FIG. 2 is referred to as a cartridge insertion direction D. In the present embodiment, the photoconductor cartridge B and the developing cartridge C are described as being attached to and detached from the apparatus body A in approximately the same direction perpendicular to a reference axis direction X, that is, right and left sides of FIG. 1, but the attachment/detachment direction can be varied arbitrarily.

The apparatus body A includes a driven-side plate 15 which is opposed to the photoconductor cartridge B and the developing cartridge C in the attached state from a drive side in the reference axis direction X, and a non-driven-side plate 16 which is opposed from a non-drive side thereto. A guide member described later for supporting attachment and detachment of the photoconductor cartridge B is attached to the driven-side plate 15 and the non-driven-side plate 16. Further, a tray 18 for supporting attachment and detachment of the developing cartridge C is arranged removably from the apparatus body A through the cartridge insertion port 17.

Figure 4:
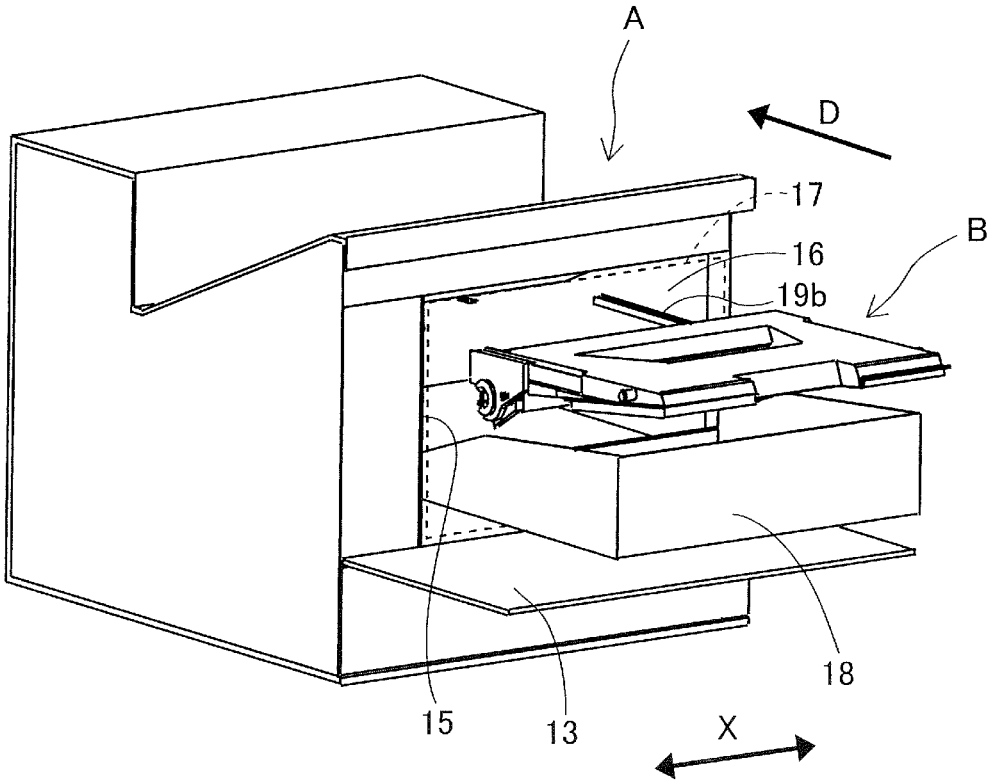
FIG. 4 is a perspective view of the apparatus body and a photoconductor cartridge according to the first embodiment.

At first, an attachment and detachment configuration of the photoconductor cartridge B will be described. As illustrated in FIG. 2, a portion 23*p* that overlaps with the photoconductor cartridge B when viewed in an insertion direction D of the cartridge is provided on the developing cartridge C. The portion 23*p* is shaped so that an upper surface of the developer container 23 is protruded upward at a portion upstream of the photoconductor cartridge B in the insertion direction D. Further, the portion 23*p* is at a planar position that differs from that of the photoconductor cartridge B, and is overlapped with the photoconductor cartridge B in terms of positions in a vertical direction (i.e., gravity direction). Thereby, the photoconductor cartridge B will not be attached and detached in a state where the developing cartridge C is attached to the apparatus body A, and as illustrated in FIG. 4, it can be attached to and detached from the apparatus boy A in a state where the developing cartridge C is not attached. A capacity of the developer container 23 can be increased by utilizing a space that overlaps with the photoconductor cartridge B when viewed in the insertion direction D by the portion 23*p*, and amount of toner filled in the toner chamber 29 in a new state and/or a capacity of a waste toner chamber 30 described later can be set high.

Figure 5:
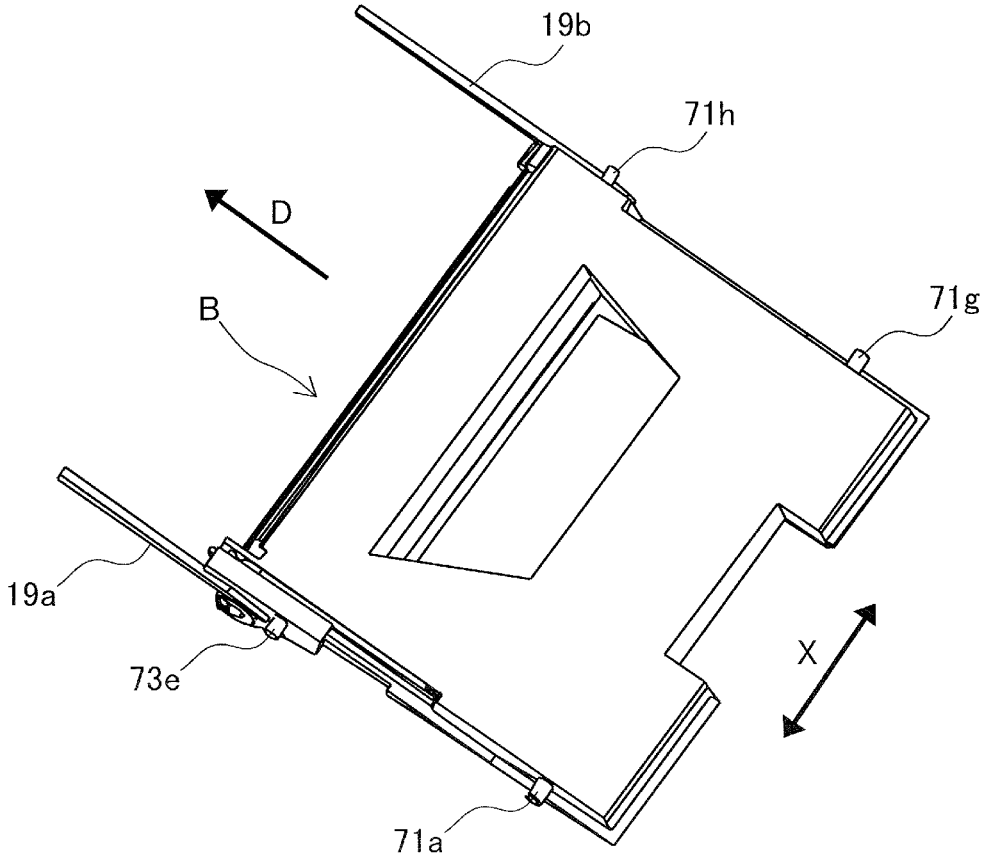
FIG. 5 is a perspective view of the photoconductor cartridge and a guide member of the apparatus body according to the first embodiment.

FIG. 5 is a perspective view illustrating a guide configuration for guiding the insertion of the photoconductor cartridge B with respect to the apparatus body A. Guide members 19*a* and 19*b* serving as a guide unit according to the present embodiment are provided on the apparatus body A (refer further to FIG. 3). First guided portions 73*e* and 71*h* and second guided portions 71*a* and 71*g* guided by the guide members 19*a* and 19*b* are provided on the photoconductor cartridge B. The first guided portions 73*e* and 71*h* are arranged on both sides of the cartridge in the reference axis direction X, and the second guided portions 71*a* and 71*g* are also provided on both sides of the cartridge in the reference axis direction X. With respect to the insertion direction D, the first guided portions 73*e* and 71*h* are positioned downstream of the second guided portions 71*a* and 71*g*. These guided portions in the present embodiment are both shaft members, i.e., boss shaped members, that protrude to the reference axis direction X from the side surface of the cartridge.

Figure 6A:
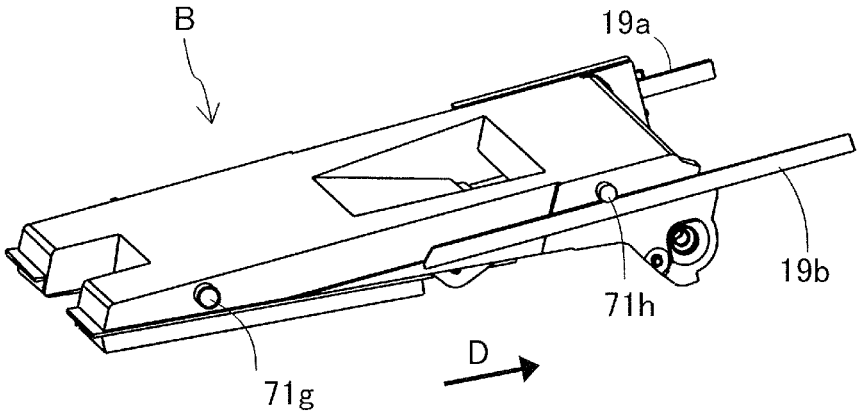
FIG. 6A is a view illustrating an insertion operation of the photoconductor cartridge according to the first embodiment.
Figure 6B:
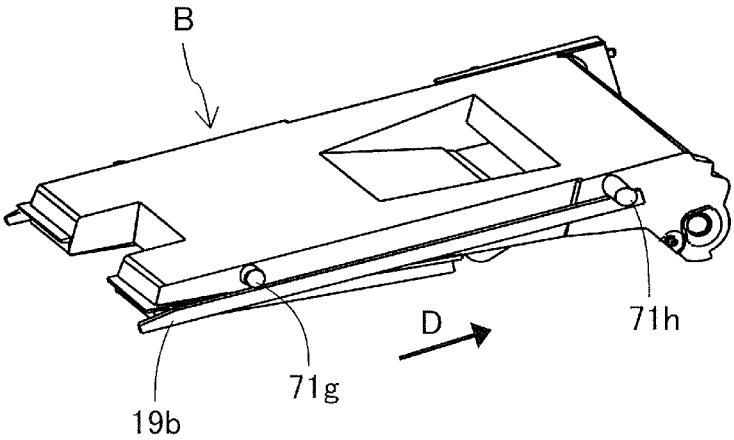
FIG. 6B is a view illustrating an insertion operation of the photoconductor cartridge according to the first embodiment.
Figure 6C:
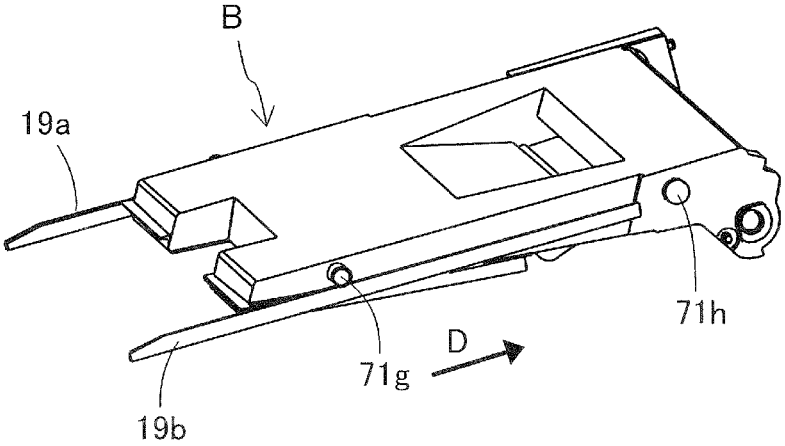
FIG. 6C is a view illustrating an insertion operation of the photoconductor cartridge according to the first embodiment.

FIGS. 6A to 6C illustrate an operation of the guide members 19*a* and 19*b* in a state where the photoconductor cartridge B is attached to the apparatus body A. The driven-side guide member 19*a* and corresponding guided portions 73*e* and 71*a* are not shown, but an operation similar to the operation of the non-drive side described later is performed.

First, an operator such as a user or a maintenance staff inserts the photoconductor cartridge B in the insertion direction D so that the first guided portions 73*e* and 71*h* contact an upper surface of the guide members 19*a* and 19*b* (FIG. 6A). Further, the operator inserts the photoconductor cartridge B along the guide member 19*b*, by which both the first guided portion 71*h* and the second guided portion 71*g* contact the guide member 19*b* and are guided in the insertion direction D (FIG. 6B).

Furthermore, the photoconductor cartridge B is inserted and the first guided portion 71*h* gets apart from the guide member 19*b*. At approximately the same timing, the first guided portion 73*e* on the drive side gets apart from the guide member 19*a*. Since the first guided portions 73*e* and 71*h* leave the guide members 19*a* and 19*b*, the photoconductor cartridge B swings downward by its own weight around the second guided portions 71*a* and 71*g* supported by the guide members 19*a* and 19*b*.

As described later, a drive shaft support member 1 that supports a drive side end portion of the photoconductor cartridge B and a non-drive side support member 12 that supports anon-drive side end portion of the photoconductor cartridge B are provided on the apparatus body A. Regarding the position of the photoconductor cartridge B in the insertion direction D, a range in which the guide members 19*a* and 19*b* can support the first guided portions 73*e* and 71*h* partially overlaps with a range in which the drive shaft support member 1 and the non-drive side support member 12 can support the photoconductor cartridge B. Actually, the range in which the drive shaft support member 1 and the non-drive side support member 12 can support the photoconductor cartridge B refers to a range in which second support portions 1*b* and 12*b* of the respective support members 1 and 12 can support supported portions 73*d* and 71*f* of the photoconductor cartridge B in FIGS. 15 and 16. The drive shaft support member 1 and the non-drive side support member 12 will be described in detail later.

Accordingly, in a state where the first guided portions 73*e* and 71*h* have gotten apart from the guide members 19*a* and 19*b*, the photoconductor cartridge B will be in a state supported by the drive shaft support member 1 and the non-drive side support member 12 on the downstream side of the insertion direction D. In this state, the second guided portions 71*a* and 71*g* are supported by the guide members 19*a* and 19*b* at a side upstream of the insertion direction D. Then, when the photoconductor cartridge B is further inserted and reaches a predetermined attachment position with respect to the apparatus body A, the photoconductor cartridge B is positioned with respect to the apparatus body A and in a state coupled to a driving source of the apparatus body A (FIG. 6C). The positioning configuration and the drive transmission configuration of the photoconductor cartridge B will be described later.

Figure 7A:
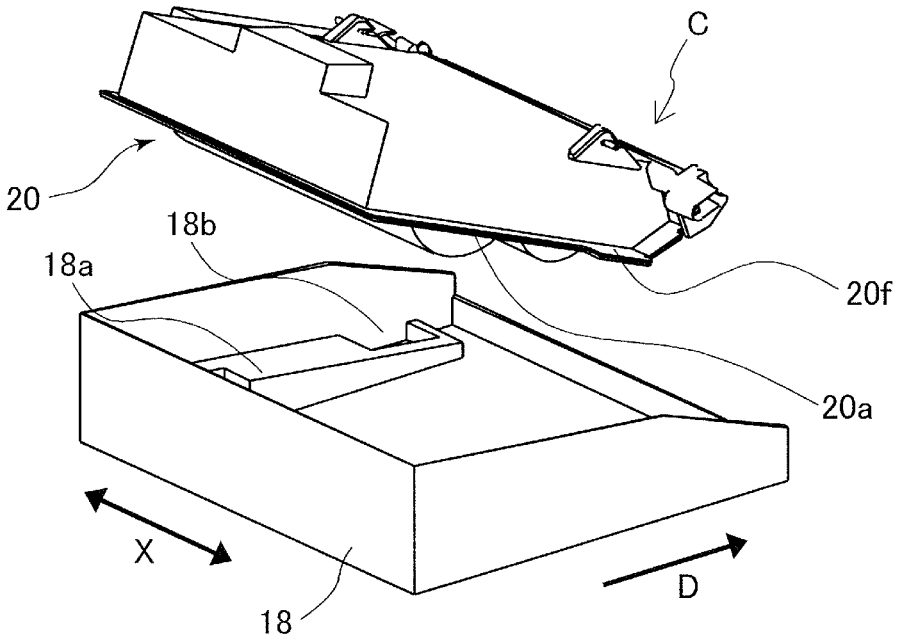
FIG. 7A is a perspective view of a developing cartridge and a tray according to the first embodiment.
Figure 7B:
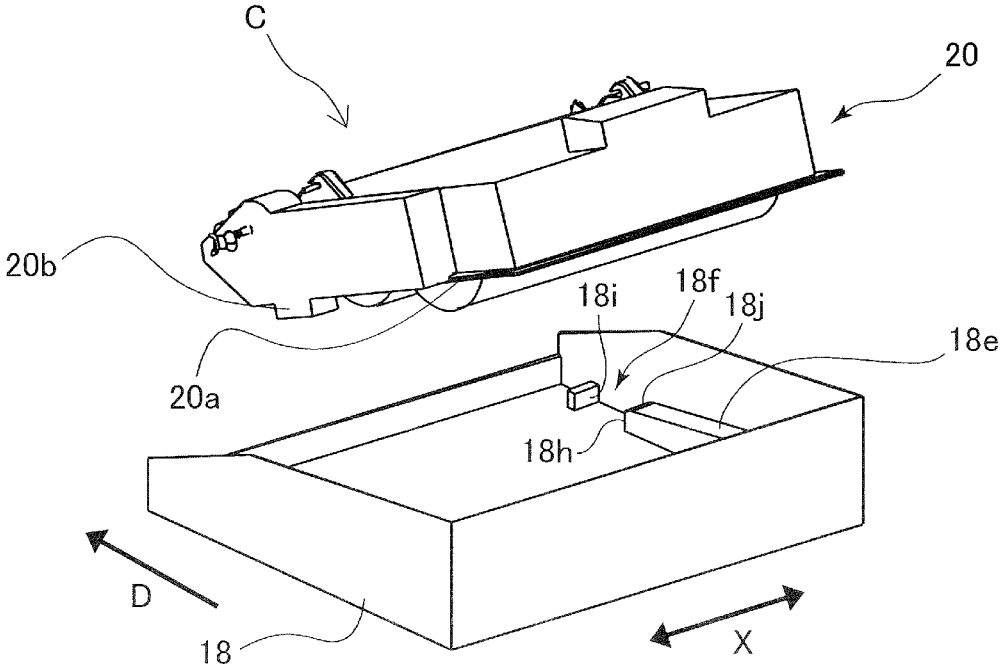
FIG. 7B is a perspective view of a developing cartridge and a tray according to the first embodiment.

Next, an attachment and detachment configuration of the developing cartridge C will be described. As illustrated in FIGS. 7A and 7B, the attachment and detachment of the developing cartridge C is performed in a state loaded (supported) on the tray 18. The tray 18 serving as a drawer member according to the present embodiment is supported by a rail provided on the apparatus body A to be inserted to and drawn out the apparatus body A. The tray 18 includes supporting surfaces 18*a* and 18*e* that support a supported surface 20*a* provided on the developing cartridge C, and position regulating portions 18*b* and 18*f* that regulate the position of the developing cartridge C with respect to the tray 18. The position regulating portions 18*b* and 18*f* according to the present embodiment adopt approximately rectangular recessed shapes that are recessed downward in the vertical direction from the supporting surfaces 18*a* and 18*e*. A regulated portion 20*b* that fits to the position regulating portion 18*b* is provided at a position protruding downward with respect to the supported surface 20*a* on a driven-side end portion at the bottom surface of the developing cartridge C, as illustrated in FIG. 7B. Further, a regulated portion 20*f* that fits to the position regulating portion 18*f* is formed in a plate shape that is connected to the supported surface 20*a* at anon-drive side end portion of the developing cartridge, and formed to protrude from the supported surface 20*a* to the reference axis direction X, as illustrated in FIG. 7A.

Figure 8:
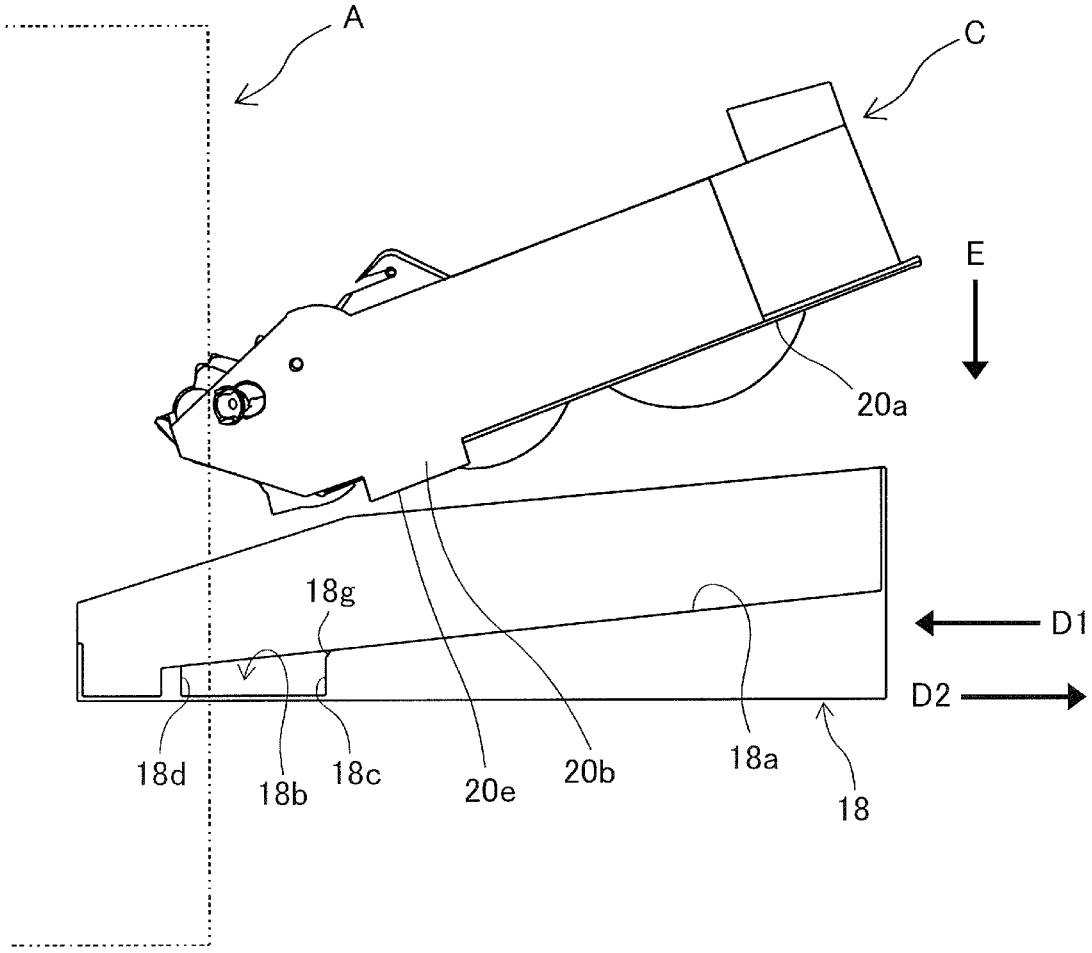
FIG. 8 is a view illustrating a state of operation in which the developing cartridge is loaded on the tray according to the first embodiment.

As illustrated in FIG. 8, the supporting surface 18*a* of the tray 18 is inclined with respect to a horizontal plane so as to extend further downward in the vertical direction as it extends downstream in the insertion direction D1 of the tray 18, which is the same direction as the insertion direction D of the developing cartridge C according to the present embodiment. The position regulating portion 18*b* includes a first regulating surface 18*c* that regulates relative movement of the regulated portion 20*b* toward a draw-out direction D2, that is, direction opposite to the insertion direction D1, with respect to the tray 18, and a second regulating surface 18*d* that regulates relative movement of the regulated portion 20*b* to the insertion direction D1 with respect to the tray 18. Further, the first regulating surface 18*c* and the supporting surface 18*a* that extend in a substantially vertical direction are connected by an inclined surface 18*g*, which is a chamfered portion.

The driven-side configuration has been described above, but the supporting surface 18*e* and the position regulating portion 18*f* on the non-drive side adopt a similar configuration. That is, as illustrated in FIG. 7B, the position regulating portion 18*f* includes a first regulating surface 18*h* that regulates relative movement of the regulated portion 20*f* of the developing cartridge C in the draw-out direction D2 with respect to the tray 18. Further, the position regulating portion 18*f* includes a second regulating surface 18*i* that regulates relative movement of the regulated portion 20*b* in the insertion direction D1 with respect to the tray 18. Further, the first regulating surface 18*h* and the supporting surface 18*e* that extend in an approximately vertical direction are connected by an inclined surface 18*j*, which is a chamfered portion.

In a state where the operator moves the tray 18 in the insertion direction D1, the developing cartridge C may receive force in the draw-out direction D2 from a member provided on the apparatus body A. Even in such a case, the first regulating surfaces 18*c* and 18*h* of the tray 18 press the regulated portions 20*b* and 20*f* of the developing cartridge C, by which the developing cartridge C moves integrally with the tray 18 in the insertion direction D1. Further, in a state where the operator moves the tray 18 in the draw-out direction D2, the developing cartridge C may receive force in the insertion direction D1 from a member provided on the apparatus body A. Even in such a case, the second regulating surfaces 18*d* and 18*i* of the tray 18 press the regulated portions 20*b* and 20*f* of the developing cartridge C, by which the developing cartridge C moves integrally with the tray 18 in the draw-out direction D2.

According to the present embodiment, a configuration example has been illustrated where the regulated portions 20*b* and 20*f* are protruded and the position regulating portions 18*b* and 18*f* are fit to the regulated portions 20*b* and 20*f*, but other configurations can be adopted to regulate relative movement of the developing cartridge C with respect to the tray 18. For example, one or more projected portions that protrude upward from a bottom surface of the tray 18 can be provided, and the developing cartridge C can be provided with recessed portions that fit to the projected portions. Even in this case, the projected portions fits to the recessed portions to regulate relative movement of the developing cartridge C to the insertion direction D1 and the draw-out direction D2 with respect to the tray 18, and the developing cartridge C can be moved along with the insertion or drawing out of the tray 18. Further, configurations corresponding to the position regulating portions 18*b* and 18*f* and the regulated portions 20*b* and 20*f* can be provided at arbitrary positions that differ from the illustrated positions in a plane coordinate of the tray 18. Similar effects can be achieved by this configuration.

FIGS. 8 to 12 illustrate a state where the operation for having the tray 18 support the developing cartridge C is viewed from the drive side in the reference axis direction X. In the following description, the operation performed at the drive side will be described, but a similar operation is also performed at the non-drive side.

Figure 9:
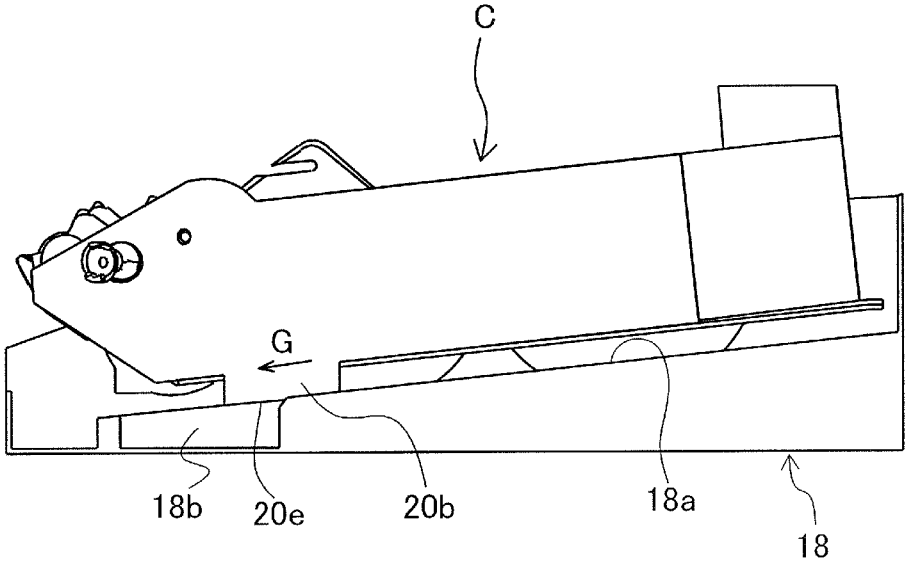
FIG. 9 is a view illustrating the state of operation in which the developing cartridge is loaded on the tray according to the first embodiment.

As illustrated in FIG. 8, the developing cartridge C is set from above to the tray 18 that has been drawn out to a predetermined position where attaching and detaching of the developing cartridge C to and from the apparatus body A is enabled. The operator lowers the cartridge from above the tray 18 downward while holding a holding part of the developing cartridge C (arrow E). Then, as illustrated in FIG. 9, a bottom surface 20*e* of the regulated portion 20*b* contacts the supporting surface 18*a* of the tray 18. Since the supporting surface 18*a* is inclined, the operator can easily move the developing cartridge C to a position where the regulated portion 20*b* fits to the position regulating portion 18*b* by sliding the developing cartridge C in a direction denoted by arrow G.

Figure 10:
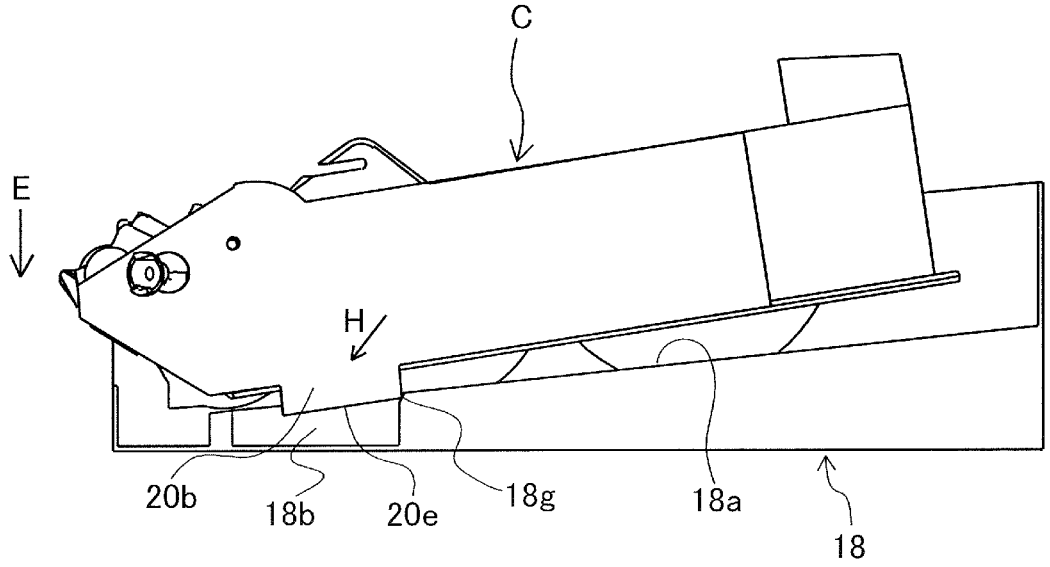
FIG. 10 is a view illustrating the state of operation in which the developing cartridge is loaded on the tray according to the first embodiment.
Figure 11:
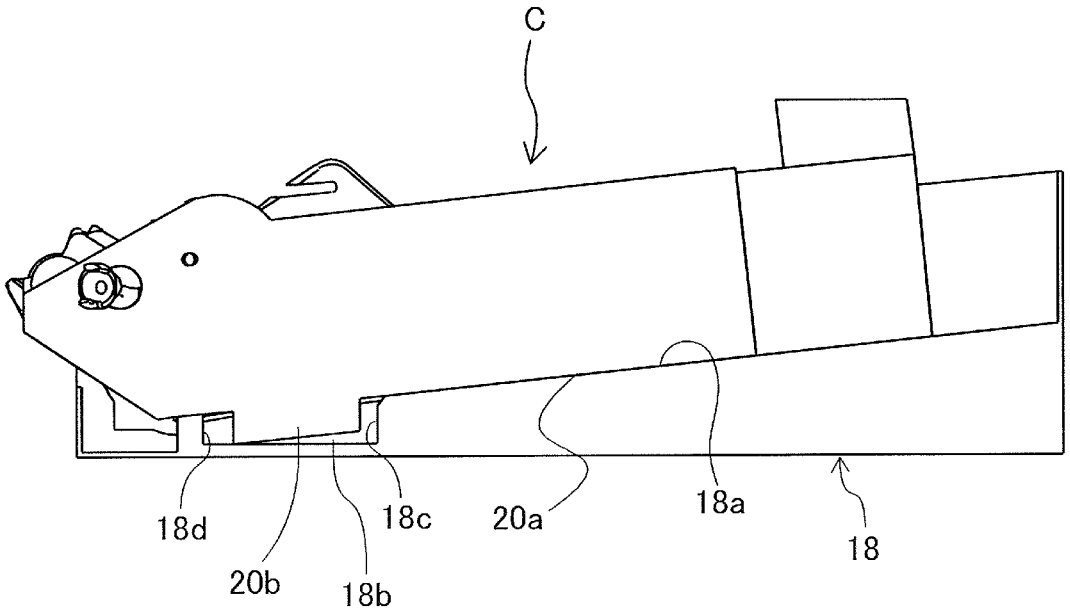
FIG. 11 is a view illustrating the state of operation in which the developing cartridge is loaded on the tray according to the first embodiment.

As illustrated in FIG. 10, when the regulated portion 20*b* approaches the position regulating portion 18*b*, the bottom surface 20*e* of the regulated portion 20*b* gets apart from the supporting surface 18*a* and contacts the inclined surface 18*g*. Since the inclination of the inclined surface 18*g* is greater than the supporting surface 18*a*, the regulated portion 20*b* slides down in an arrow H direction along the inclined surface 18*g* by the own weight of the developing cartridge C, and the regulated portion 20*b* gets apart from the inclined surface 18*g* and falls in a direction denoted by arrow E. As a result, as illustrated in FIG. 11, the regulated portion 20*b* of the developing cartridge C fits to the position regulating portion 18*b* and the supported surface 20*a* is supported by the supporting surface 18*a*, by which the setting of the developing cartridge C to the tray 18 is completed. In the state illustrated in FIG. 11, the weight of the developing cartridge C is supported via the tray 18 by the apparatus body A, and movement of the developing cartridge C in a horizontal direction with respect to the tray 18 is regulated.

Thereafter, the developing cartridge C loaded on the tray 18 is inserted in the insertion direction D1 so as to be attached to the apparatus body A. As described earlier, the photoconductor cartridge B is configured to be attached to and detached from the apparatus body A in a state where the developing cartridge C is not attached. Therefore, the attachment operation of the developing cartridge C is normally performed in a state where the photoconductor cartridge B has been attached to the apparatus body A.

Supporting Configuration of Cartridge

Next, a supporting configuration of the photoconductor cartridge B and the developing cartridge C in a state attached to the apparatus body A will be described. While being attached to the apparatus body A, the photoconductor cartridge B is supported by the driven-side plate 15 and the non-driven-side plate 16 (FIG. 3) of the apparatus body A.

Figure 15:
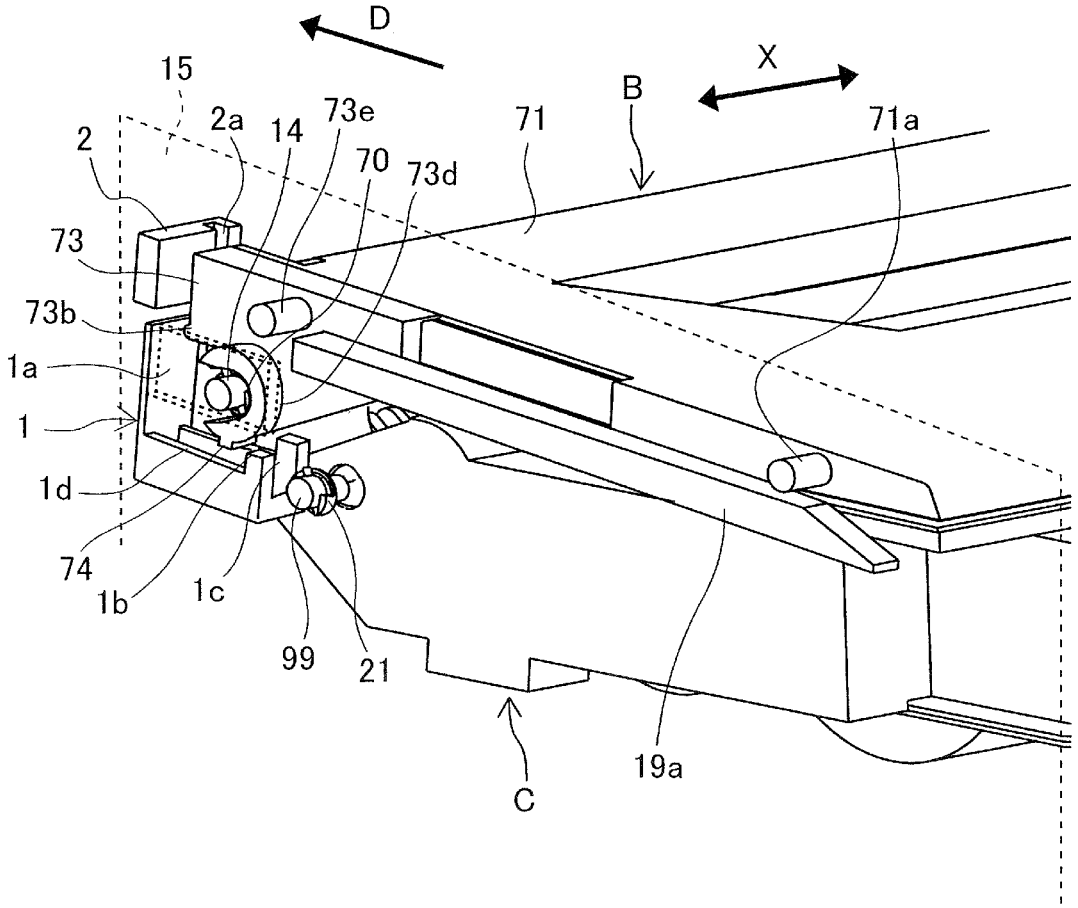
FIG. 15 is a view illustrating a supporting configuration of the photoconductor cartridge according to the first embodiment.

As illustrated in FIG. 15, the drive shaft support member 1 and the above-mentioned guide member 19*a* are provided on the driven-side plate 15. The drive shaft support member 1 is a member in which a first supporting portion 1*a*, a second supporting portion 1*b*, a guide groove 1*c* and a cutout portion 1*d* are integrally formed, and it rotatably supports a first drive shaft 14 described later. A first supported portion 73*b* supported by the first supporting portion 1*a* and a second supported portion 73*d* supported by the second supporting portion 1*b* are provided on the drum bearing 73 of the photoconductor cartridge B. On the drive side of the reference axis direction X, the photoconductor cartridge B in the attached state is supported by the apparatus body A in a state where the first supported portion 73*b*, the second supported portion 73*d* and the second guided portion 71*a* are respectively in contact with the first supporting portion 1*a*, the second supporting portion 1*b* and the guide member 19*a*. The guide groove 1*c* and the cutout portion 1*d* of the drive shaft support member 1 will be described later.

Figure 16:
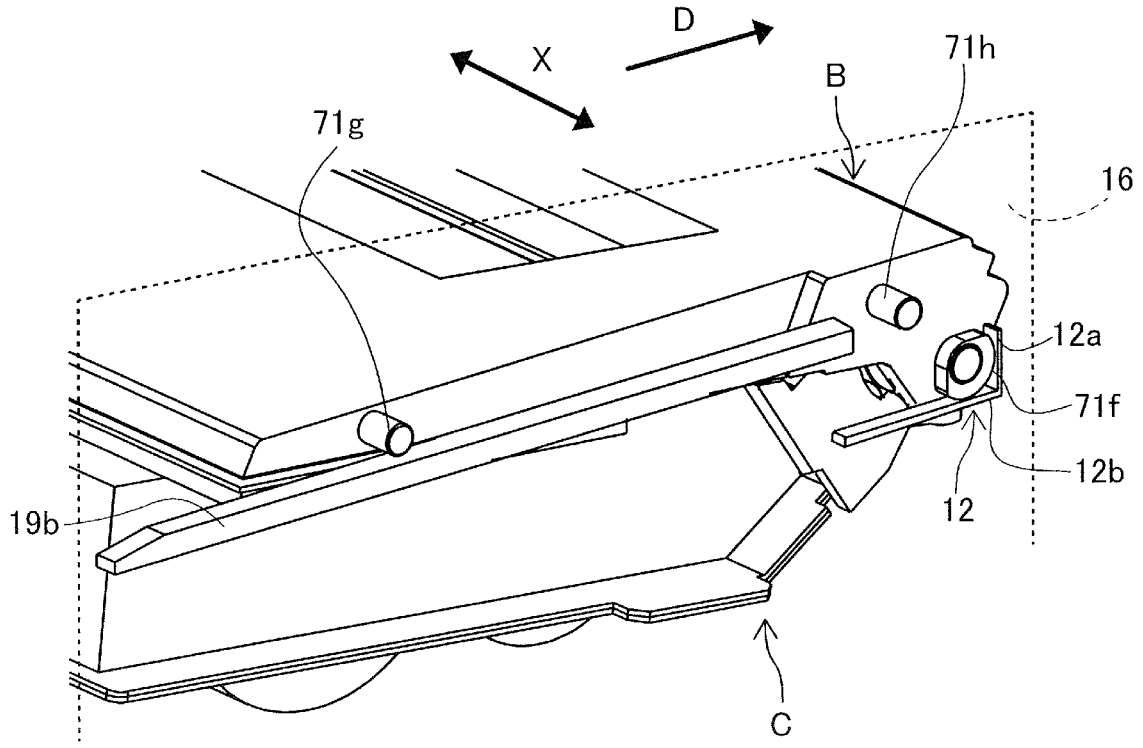
FIG. 16 is a view illustrating the supporting configuration of the photoconductor cartridge according to the first embodiment.

Further, as illustrated in FIG. 16, the non-drive side support member 12 and the guide member 19*b* are provided on the non-driven-side plate 16. The non-drive side support member 12 includes a first supporting portion 12*a* and a second supporting portion 12*b*. A projection 71*f* supported by the first supporting portion 12*a* and the second supporting portion 12*b* are provided on the cleaning frame member 71 of the photoconductor cartridge B. On the non-drive side of the reference axis direction X, the photoconductor cartridge B in the attached state is supported by the apparatus body A in a state where the projection 71*f* is in contact with the first supporting portion 12*a* and the second supporting portion 12*b* and where the second guided portion 71*g* is in contact with the guide member 19*a*.

Figure 18:
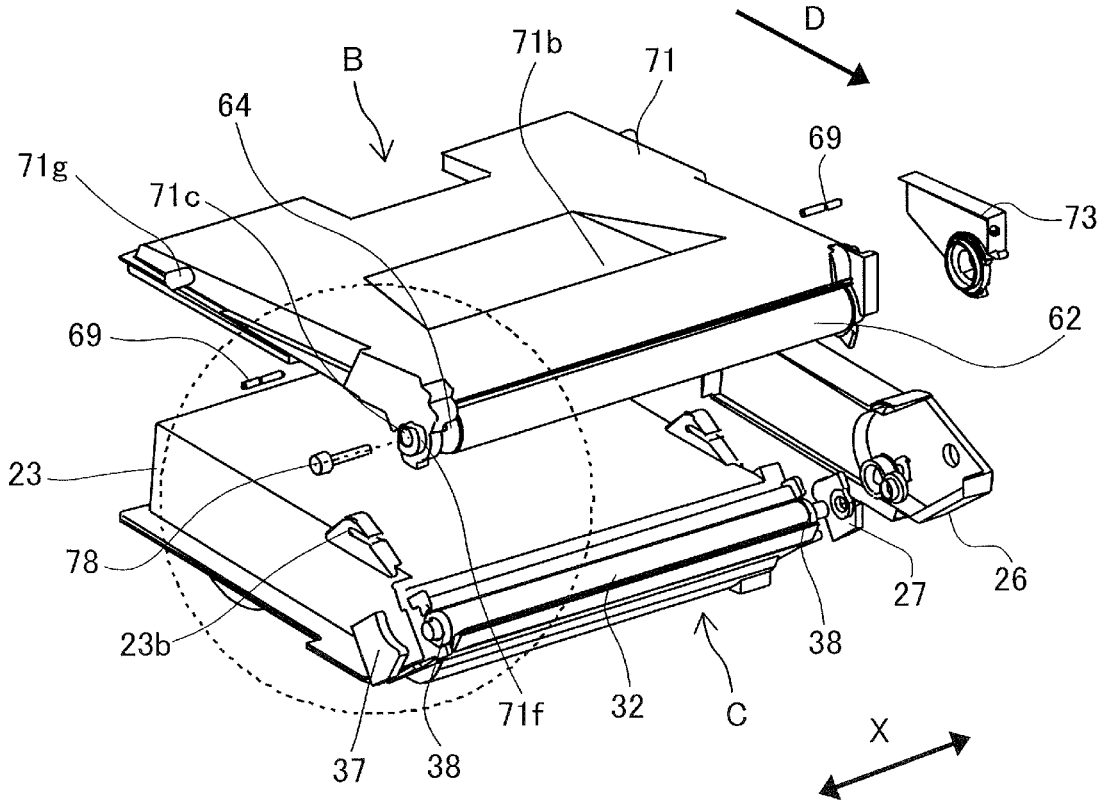
FIG. 18 is an exploded view of a process unit according to the first embodiment.
Figure 20:
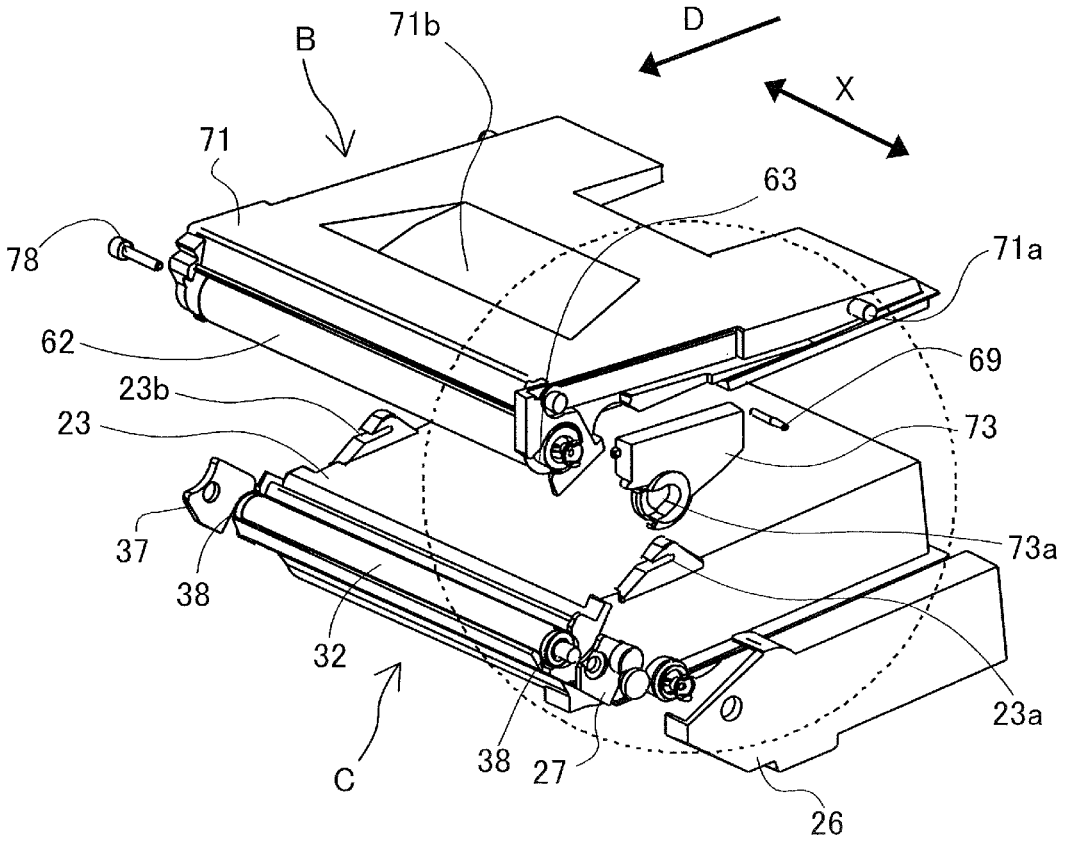
FIG. 20 is an exploded view of the process unit according to the first embodiment.

Next, a supporting configuration of the developing cartridge C will be described. As illustrated in FIGS. 18 and 20, a first support hole 23*a* and a second support hole 23*b* are provided at both ends of the developing cartridge C in the reference axis direction X. The first support hole 23*a* and the second support hole 23*b* serving as engaged portions according to the present embodiment are formed on the developer container 23 in forms of trenches (or cut-outs) that extend in the insertion direction D of the cartridge.

As illustrated in FIGS. 19 and 21, first suspended holes 71*i* and 71*i* and second suspended holes 71*j* and 71*j* are provided at both end portions in the reference axis direction X of the photoconductor cartridge B, and coupling pins 69 and 69 are respectively press-fit to the first suspended holes 71*i* and the second suspended holes 71*j*. Note that FIG. 19 is a perspective view in which a portion denoted by a circle in FIG. 18 is viewed from a lower side, and FIG. 21 is a perspective view in which a portion denoted by a circle in FIG. 20 is viewed from a lower side. The coupling pin 69 is each a shaft-like member that extends in the reference axis direction X. The coupling pins 69 and 69 each serve as an engagement portion engaged to the first support hole 23*a* and the second support hole 23*b* according to the present embodiment.

Figure 12:
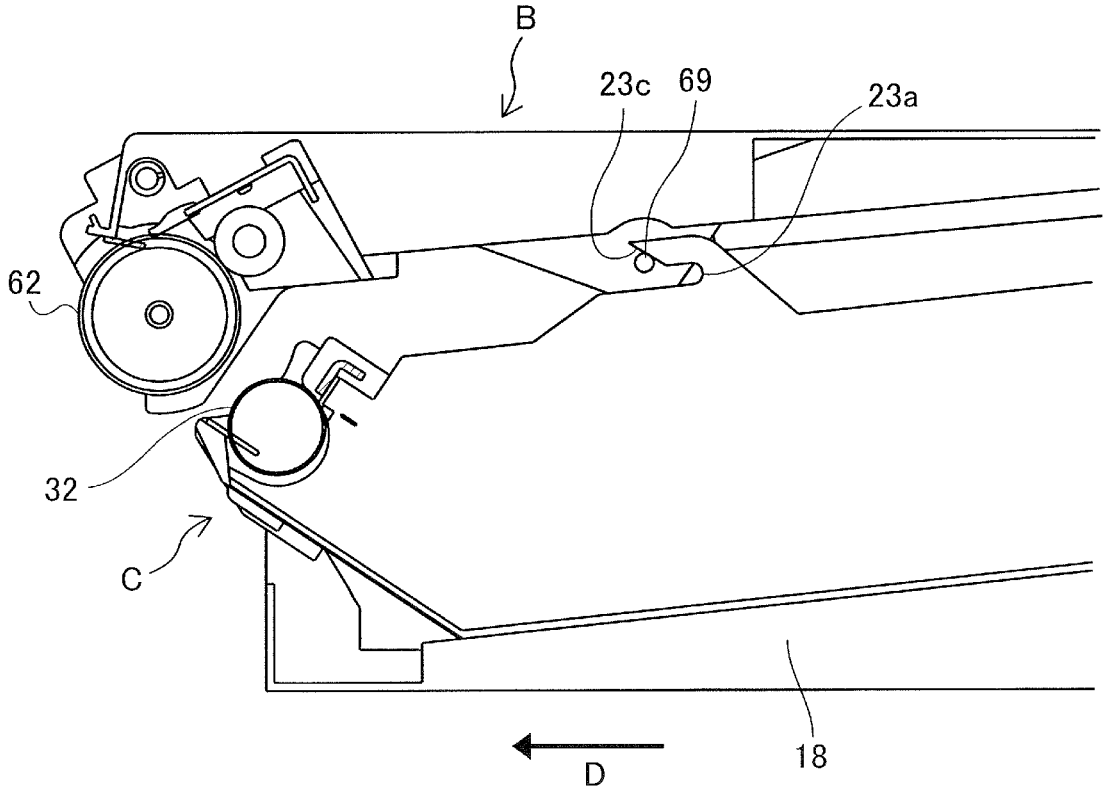
FIG. 12 is a view illustrating an engagement of the developing cartridge and the photoconductor cartridge according to the first embodiment.
Figure 13:
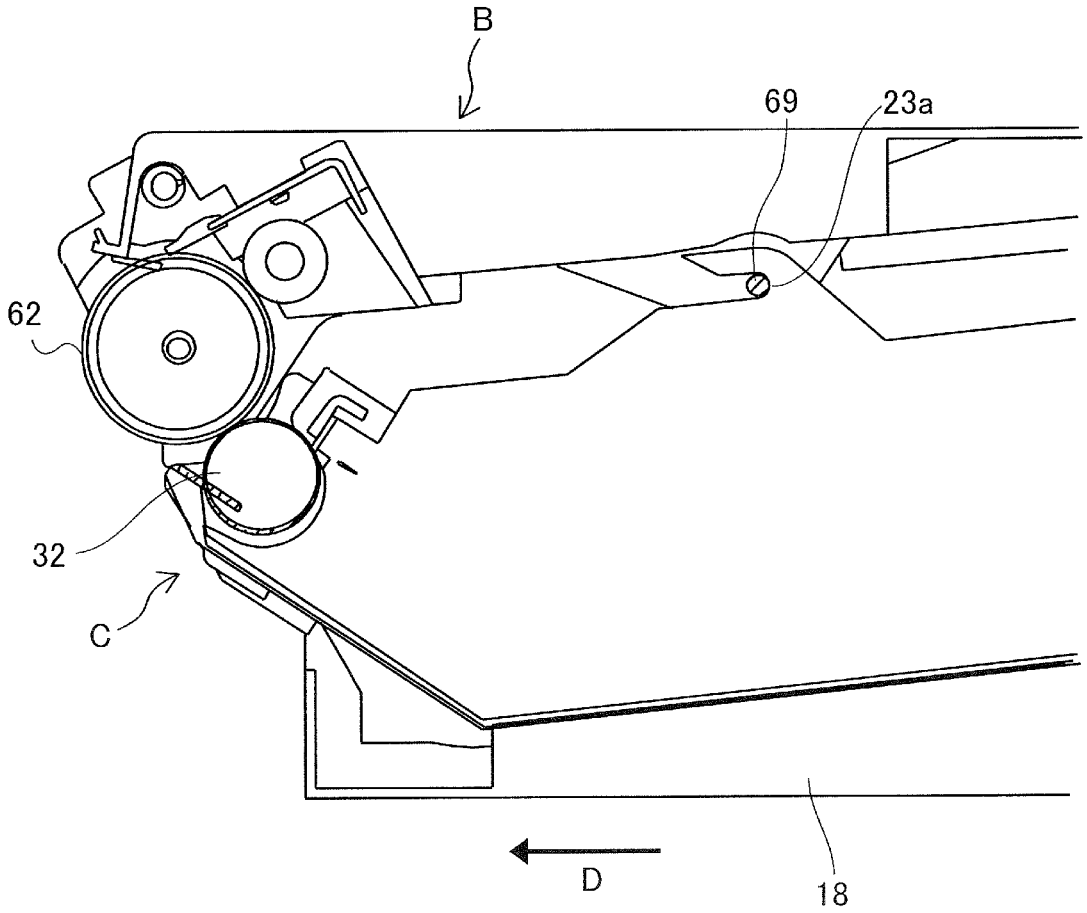
FIG. 13 is a view illustrating the engagement of the developing cartridge and the photoconductor cartridge according to the first embodiment.
Figure 14:
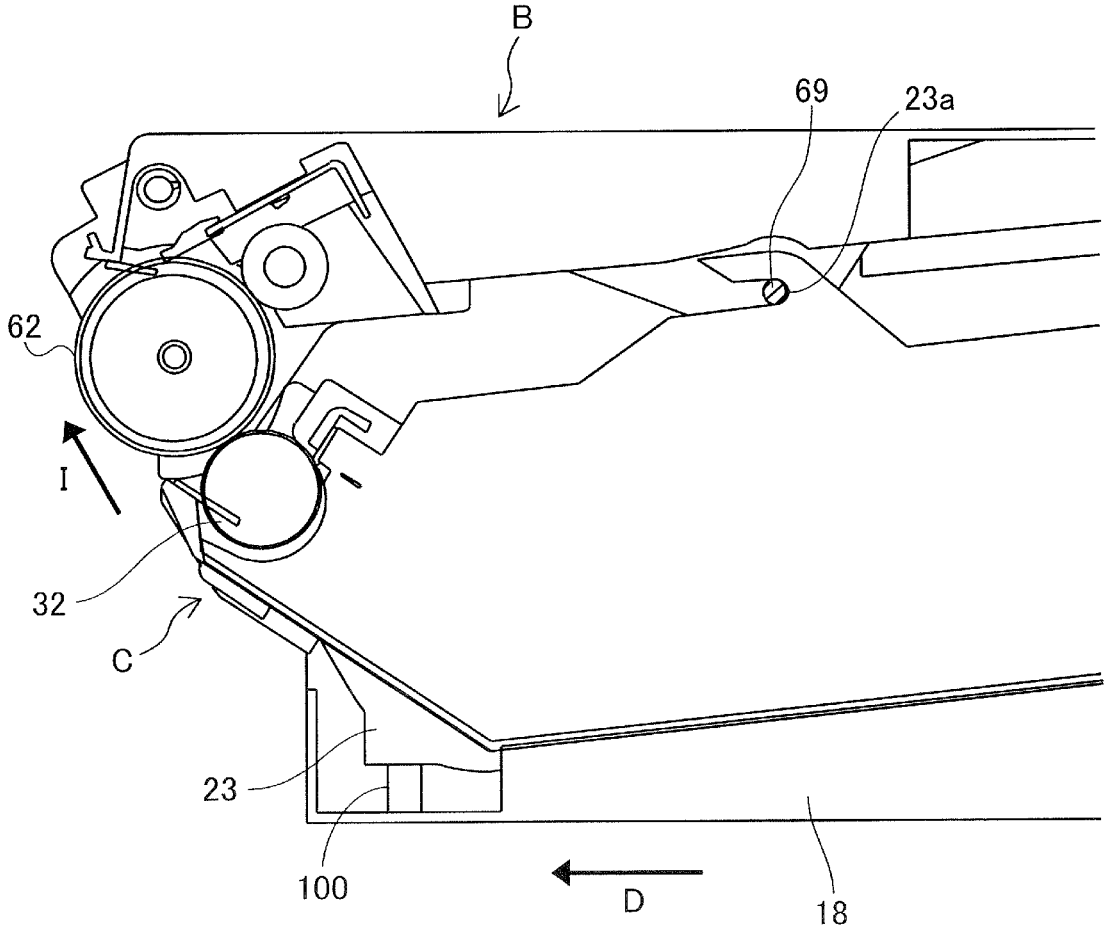
FIG. 14 is a view illustrating the engagement of the developing cartridge and the photoconductor cartridge according to the first embodiment.

FIGS. 12 to 14 respectively illustrate a state where the developing cartridge C and the photoconductor cartridge B are engaged during a process in which the developing cartridge C is inserted to the apparatus body A. Hereafter, the operation viewed from the drive side in the reference axis direction X will be described, but a similar operation is also realized on the non-drive side by the second support hole 23*b* and the coupling pin 69.

As described above, the developing cartridge C is inserted together with the tray 18 to the apparatus body A in the insertion direction D in a state being placed on the tray 18. As illustrated in FIG. 12, an inclined surface 23*c* is formed on an opening portion of the first support hole 23*a*, and when the developing cartridge C is inserted, the inclined surface 23*c* initially contacts the coupling pin 69 of the photoconductor cartridge B.

The inclined surface 23*c* is inclined with respect to a horizontal plane so as to extend upward in the vertical direction toward a downstream side in the insertion direction D. Therefore, if the developing cartridge C is further inserted after the inclined surface 23*c* contacts the coupling pin 69, the inclined surface 23*c* rides on the coupling pin 69 and the developing cartridge C lifts up. Then, as illustrated in FIG. 13, the first support hole 23*a* will be engaged to the coupling pin 69, that is, an area close to the bottom of the trench-shaped hole than the inclined surface 23*c* is in contact with the coupling pin 69. Simultaneously, on the opposite side in the reference axis direction X, the second support hole 23*b* contacts the coupling pin 69 at the inclined surface 23*c* before being engaged with the coupling pin 69.

In the state where the first support hole 23*a* and the second support hole 23*b* are engaged with the coupling pin 69, at least a portion of the weight of the developing cartridge C will be supported by the photoconductor cartridge B through the coupling pin 69. The developing cartridge C is capable of swinging in a direction in which the developing roller 32 moves toward and away from the photosensitive drum 62 while the coupling pin 69 acting as a fulcrum. As illustrated in FIG. 14, in a state where an urging member 100 provided on the tray 18 pushes a bottom surface, that is, bottom portion, of the developer container 23 of the developing cartridge C upward, the developing roller 32 receives urging force in an I direction around the coupling pin 69. Thereby, the gap retainer 38 mentioned above contacts the photosensitive drum 62, and the developing roller 32 is positioned with respect to the photosensitive drum 62. The urging member 100 serving as an urging portion according to the present embodiment is a spring member provided on a bottom portion of the tray 18, for example.

In a state where the developing cartridge C moves by having the inclined surface 23*c* of the first support hole 23*a* and the second support hole 23*b* ride on the coupling pin 69, the coupling pin 69 pushes back the inclined surface 23*c*, by which a force opposite to the insertion direction D acts on the developing cartridge C. However, as described above, since the first regulating surfaces 18*c* and 18*h* of the position regulating portions 18*b* and 18*f* provided on the tray 18 push the regulated portions 20*b* and 20*f* of the developing cartridge C in the insertion direction D, the developing cartridge C can move to the insertion direction D together with the tray 18. The fitting length in the up-down direction of the first regulating surfaces 18*c* and 18*h* and the regulated portions 20*b* and 20*f* is set so that the first regulating surfaces 18*c* and 18*h* maintain contact with the regulated portions 20*b* and 20*f* even in a state where the inclined surface 23*c* rides on the coupling pin 69.

When drawing out the tray 18, in a state where the coupling pin 69 is withdrawn from the first support hole 23*a* and the second support hole 23*b*, a force in the insertion direction D that is opposite to the draw-out direction acts on the developing cartridge C. However, as described above, the second regulating surfaces 18*d* and 18*i* of the position regulating portions 18*b* and 18*f* provided on the tray 18 push the regulated portions 20*b* and 20*f* of the developing cartridge C in the draw-out direction, the developing cartridge C can move to the draw-out direction together with the tray 18. The fitting length in the up-down direction of the second regulating surfaces 18*d* and 18*i* and the regulated portions 20*b* and 20*f* is set so that the second regulating surfaces 18*d* and 18*i* maintain contact with the regulated portions 20*b* and 20*f* while the coupling pin 69 is withdrawn from the first support hole 23*a* and the second support hole 23*b*.

As described, according to the present embodiment, the attachment and detachment of the photoconductor cartridge B is guided by the guide members 19*a* and 19*b* and the attachment and detachment of the developing cartridge C is performed in a state supported by the tray 18. Then, by inserting the tray 18 supporting the developing cartridge C in a direction intersecting the reference axis direction X, that is, the insertion direction D, the developing cartridge C is engaged with the photoconductor cartridge B attached to the apparatus body A. That is, the replacement operation of the cartridges is facilitated in a configuration where the image forming unit is composed of a plurality of cartridges, and an image forming unit and an image forming apparatus having a high usability can be provided.

In the present embodiment, the urging member 100 is provided on the tray 18, but the urging member can be arranged at a different location, as long as it is arranged to apply force in a direction abutting the developing roller against the photosensitive drum. The trench shape of the first support hole 23*a* and the second support hole 23*b* is preferably somewhat inclined with respect to the horizontal plane so that it rises in the vertical direction as it extends upstream in the insertion direction D, as according to the present embodiment. Thereby, it becomes possible to prevent respective support holes engaged to the coupling pin 69 from slipping out of the coupling pin 69. Furthermore, it becomes possible to prevent slipping even further by arranging the position of the developing cartridge C in a state where the first support hole 23*a* and the second support hole 23*b* are engaged with the coupling pin 69 so that the first support hole 23*a* urges the coupling pin 69 by gravity acting on the developing cartridge C.

Further, the urging member 100 should preferably be rounded at the end portion on the upstream side in the insertion direction D of the tray 18. Thereby, the developing cartridge C can easily ride on the urging member 100 along with the operation for inserting the tray 18 to the apparatus body A.

According to the present embodiment, the developing cartridge C is designed to ride on the urging member 100 along with the insertion operation of the tray 18, but as another example, the urging member may urge the developing cartridge C by performing a predetermined operation after the insertion operation of the tray 18. For example, an opening portion through which the urging member 100 can pass may be formed on the bottom surface of the tray 18, and at the same time, the urging member 100 may be designed to move in linkage with the opening and closing of the door 13 (FIG. 3). Then, after inserting the tray 18, the door 13 is closed so that the urging member 100 can move to a position in contact with the developing cartridge C through the opening portion of the tray 18. Further, by opening the door 13, the urging member 100 can be retreated through the opening portion of the tray 18 to a position not interfering with the drawing out of the tray 18 and the developing cartridge C.

Input of Drive to Cartridge

Next, a configuration for entering drive (driving force) from the apparatus body A to the photoconductor cartridge B will be described. As illustrated in FIG. 15, a drum coupling 70 and a developing coupling 21 are provided on the driven-side side surface in the reference axis direction X of the photoconductor cartridge B and the developing cartridge C for receiving driving force from the apparatus body A. The drum coupling 70 constitutes a first connecting portion that connects to the first drive shaft 14 of the apparatus body A serving as a first shaft member, and the developing coupling 21 constitutes a second connecting portion that connects to a second drive shaft 99 of the apparatus body A serving as a second shaft member. The drum coupling 70 according to the present embodiment is arranged coaxially with the photosensitive drum 62 (refer to FIG. 21), and the drum coupling 70 together with the photosensitive drum 62 constitute a drum unit that rotates integrally and that is supported rotatably by the drum bearing 73.

The drum coupling 70 and the developing coupling 21 adopt a configuration where they can both be inclined with respect to the photoconductor cartridge B and the developing cartridge C, in other words, so that the rotational axis of the coupling member can be inclined with respect to the reference axis direction X. As described below, the drum coupling 70 and the developing coupling 21 are configured to be engaged with or withdrawn from the first drive shaft 14 and the second drive shaft 99 along with the operation in which the photoconductor cartridge B and the developing cartridge C are inserted to and drawn out of the apparatus body A.

As illustrated in FIG. 23A, in a state where the photoconductor cartridge B is not attached to the apparatus body A, the drum coupling 70 is urged so that a tip is oriented downstream in the insertion direction D by a helical torsion spring 24 serving as a first urging member. As illustrated in FIG. 23B, in a state where the photoconductor cartridge B is inserted to the apparatus body A, the drum coupling 70 is engaged with the first drive shaft 14 before the photoconductor cartridge B reaches the attachment position. That is, a key 14*a* provided on the first drive shaft 14 fits to a key groove 70*a* of the drum coupling 70, and along with the rotation of the first drive shaft 14, the drum coupling 70 will be in a rotatable state. Then, in a state where the drum coupling 70 is pressed by the first drive shaft 14 against the urging force of the helical torsion spring 24, the drum coupling 70 is substantially extended in the reference axis direction X in a state where the photoconductor cartridge B has reached the attachment position.

Similarly, as illustrated in FIG. 23C, in a state where the developing cartridge C is not attached to the apparatus body A, the developing coupling 21 is urged so that a tip is oriented downstream in the insertion direction D by a helical torsion spring 25 serving as a second urging member. As illustrated in FIG. 23D, in a state where the developing cartridge C is inserted to the apparatus body A, the developing coupling 21 is engaged with the second drive shaft 99 before the developing cartridge C reaches the attachment position. That is, a key 99*a* provided on the second drive shaft 99 fits to a key groove 21*a* of the developing coupling 21, and along with the rotation of the second drive shaft 99, the developing coupling 21 will be in a rotatable state. Then, in a state where the developing coupling 21 is pressed by the second drive shaft 99 against the urging force of the helical torsion spring 25, the developing coupling 21 will substantially be extended in the reference axis direction X in a state where the developing cartridge C has reached the attachment position.

In the state illustrated in FIG. 23D, the photoconductor cartridge B and the developing cartridge C are respectively capable of receiving driving force from the apparatus body A through the drum coupling 70 and the developing coupling 21. As described above, since a coupling member capable of being inclined with respect to the reference axis direction X is provided, it becomes possible to smoothly connect (engage) and disconnect (disengage) drive transmission of the cartridge and the apparatus body by inserting the cartridge to the apparatus body or drawing the cartridge out of the apparatus body.

Positioning of Photosensitive Drum in Axial Direction

Figure 22:
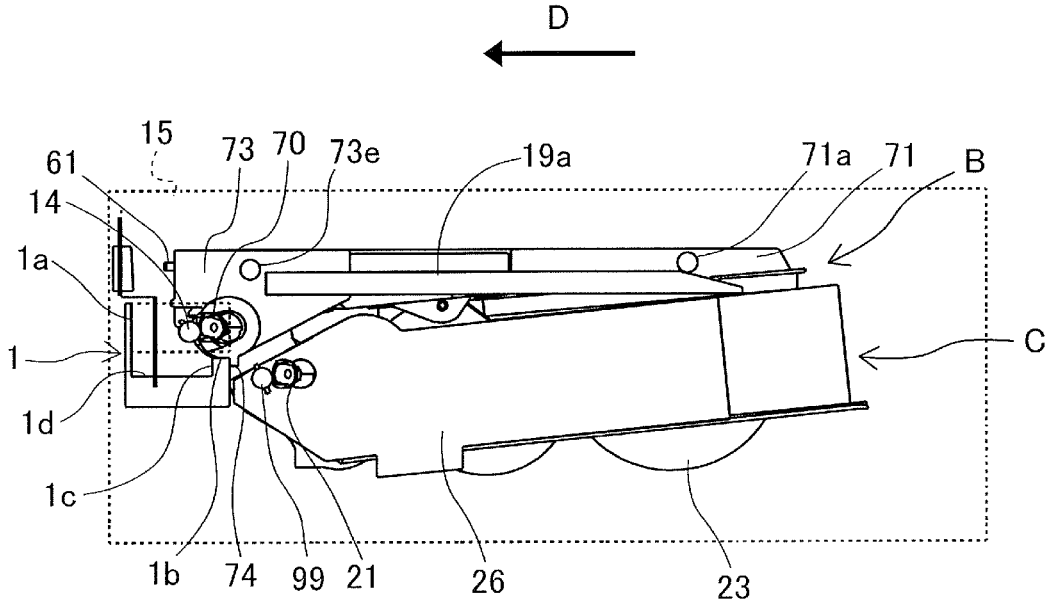
FIG. 22 is a view illustrating a positional relationship between the process unit and the members of the apparatus body according to the first embodiment.

Next, a configuration for positioning the photoconductor cartridge B with respect to the reference axis direction X will be described. As illustrated in FIGS. 15 and 22, the first drive shaft 14 of the apparatus body A is supported rotatably by the drive shaft support member 1 provided on the driven-side plate 15. The guide groove 1*c* described earlier is provided on the drive shaft support member 1 as a regulation portion for regulating the cartridge position in the reference axis direction X when attaching the photoconductor cartridge B to the apparatus body. The guide groove 1*c* according to the present embodiment is a trench-shaped groove that is dented downward on an upper surface of the second supporting portion 1*b* of the drive shaft support member 1 and extended in the insertion direction D of the cartridge. The aforementioned cutout portion 1*d* is provided on a downstream side in the insertion direction D of the guide groove 1*c*.

Further, a regulation member 2 having a regulation groove 2*a* is provided on the apparatus body A. The regulation groove 2*a* functions as a regulation portion that is provided on the apparatus body to regulate the cartridge position in the reference axis direction X in a state where the photoconductor cartridge B is attached to the apparatus body A. The regulation groove 2*a* is a trench-shaped groove that extends in a substantially vertical direction and opens upstream in the insertion direction D of the cartridge.

As illustrated in FIG. 21, a protruded portion 74 that fits to the guide groove 1*c* and a regulated portion 61 that fits to the regulation groove 2*a* are formed on the drum bearing 73 of the photoconductor cartridge B. The protruded portion 74 is protruded downward from the second supported portion 73*d* on which the drum bearing 73 is supported by the second supporting portion 1*b* of the drive shaft support member 1. Further, the regulated portion 61 is protruded downstream in the insertion direction D from an end face of the drum bearing 73 in the insertion direction D, that is, the face opposed to the regulation member 2 in the attached state.

Figure 24A:
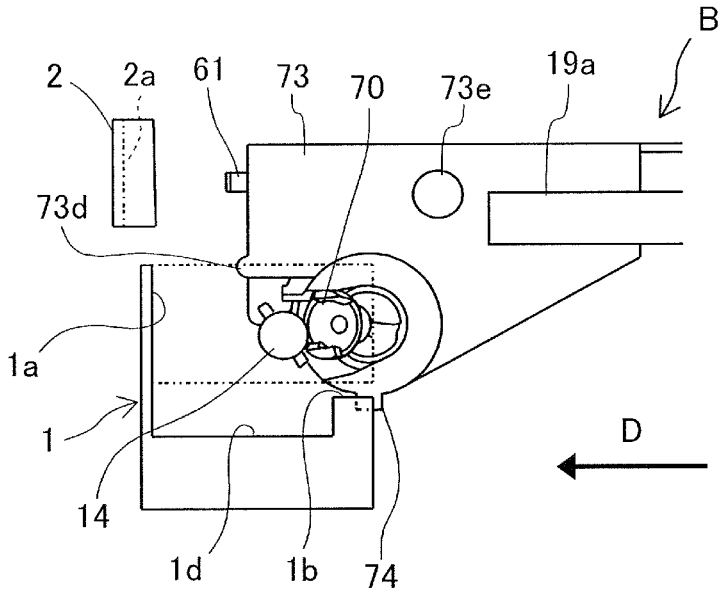
FIG. 24A is a side view illustrating a state of attachment operation of the photoconductor cartridge according to the first embodiment.
Figure 24B:
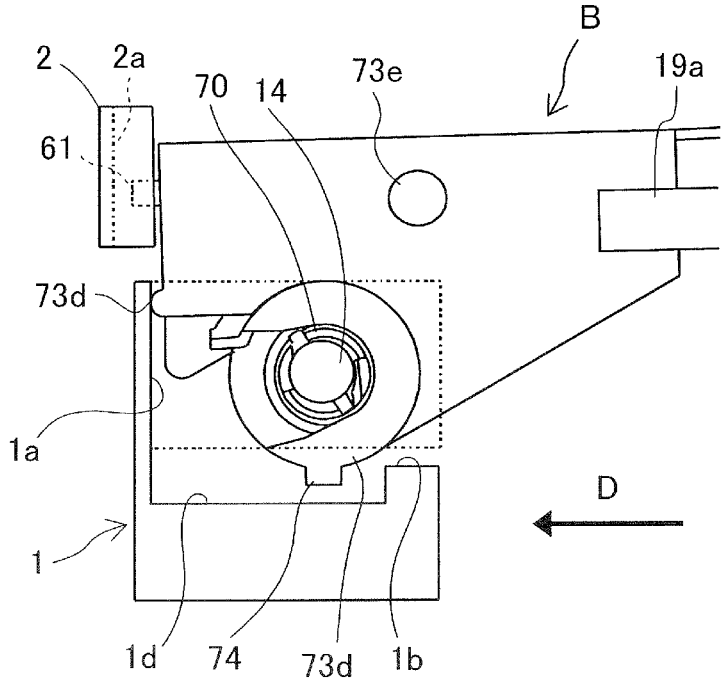
FIG. 24B is a side view illustrating the state of attachment operation of the photoconductor cartridge according to the first embodiment.
Figure 25A:
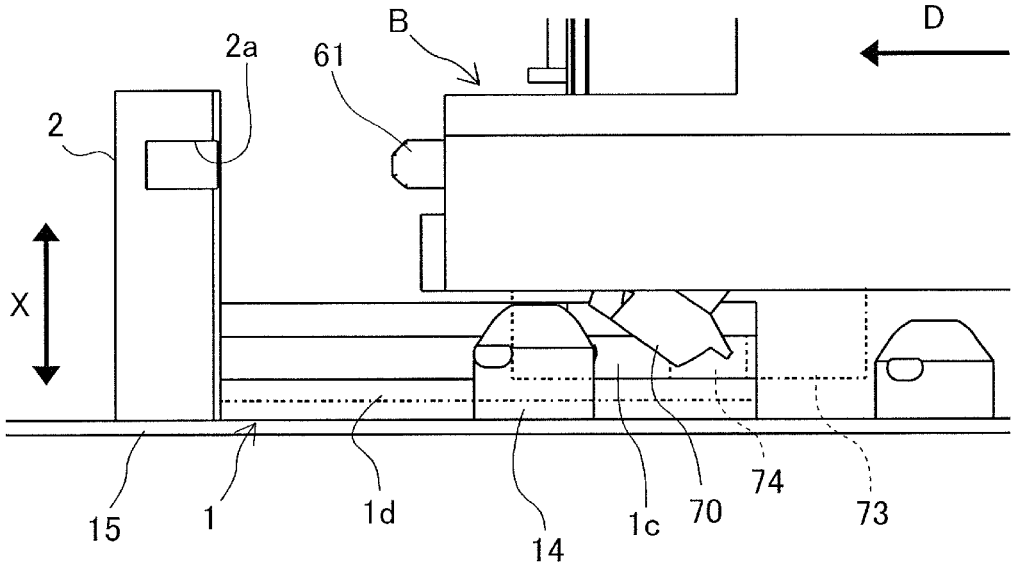
FIG. 25A is a top view illustrating the state of attachment operation of the photoconductor cartridge according to the first embodiment.
Figure 25B:
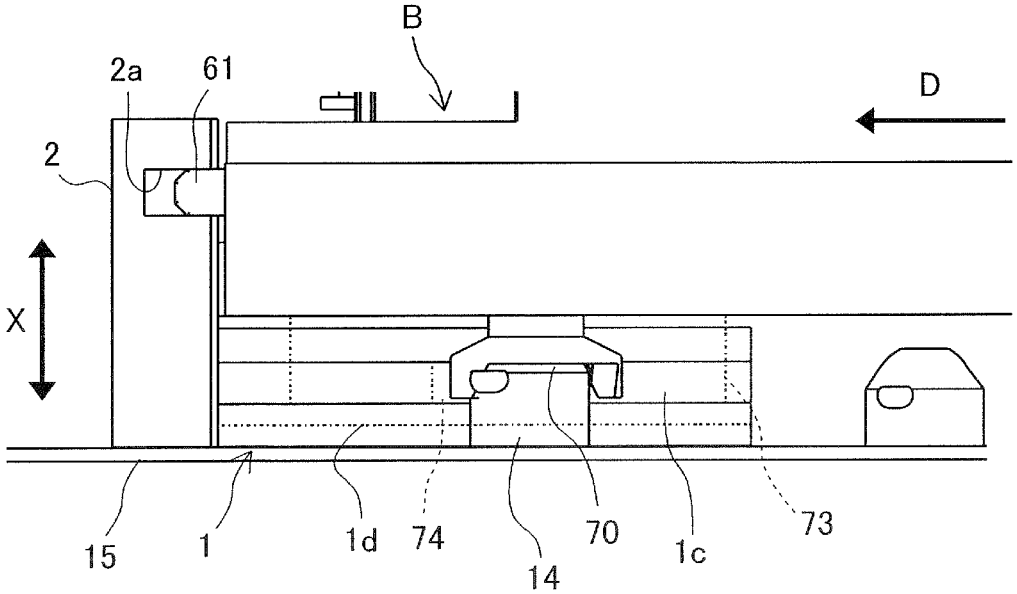
FIG. 25B is a top view illustrating the state of attachment operation of the photoconductor cartridge according to the first embodiment.

FIGS. 24 and 25 are views for describing the operation of the above-described positioning configuration when attaching the photoconductor cartridge B to the apparatus body A, wherein FIGS. 24A and 24B illustrate a state viewed in the reference axis direction X, and FIGS. 25A and 25B illustrate a state viewed from above. In a state where the photoconductor cartridge B is inserted to the insertion direction D, as illustrated in FIGS. 24A and 25A, the protruded portion 74 of the drum bearing 73 enters the guide groove 1*c* of the drive shaft support member 1. Thereby, the position of the photoconductor cartridge B in the reference axis direction X is regulated, so that the drum coupling 70 can be connected smoothly to the first drive shaft 14 along with the insertion of the photoconductor cartridge B.

When the photoconductor cartridge B moves further to the insertion direction D, as illustrated in FIGS. 24B and 25B, the protruded portion 74 of the drum bearing 73 reaches the cutout portion 1*d* of the drive shaft support member 1 and is withdrawn from the guide groove 1*c*. Therefore, the regulation of position of the photoconductor cartridge B by the fitting of the protruded portion 74 to the guide groove 1*c* is cancelled. While the photoconductor cartridge B moves to the attachment position, the regulated portion 61 provided on the drum bearing 73 fits to the regulation groove 2*a* provided on the apparatus body A. Thereby, in a state where the photoconductor cartridge B is attached to the apparatus body A, positioning of the photoconductor cartridge B in the reference axis direction X is performed by the fitting of the regulated portion 61 to the regulation groove 2*a*. The reference axis direction X is a main scanning direction of the photosensitive drum 62 in the image forming process, so that the image quality can be improved by positioning the photosensitive drum 62 with high accuracy by such positioning configuration.

A clearance between the guide groove 1*c* and the protruded portion 74 in the reference axis direction X is not necessarily matched with a clearance between the regulation groove 2*a* and the regulated portion 61 in the reference axis direction X. For example, the positioning accuracy of the photosensitive drum 62 during image forming operation may be improved by setting the former value smaller than the latter value. Further according to the present embodiment, the part used for positioning during attachment of cartridge, that is, the guide groove 1*c* and the protruded portion 74, is provided individually from apart used for positioning in the state where the cartridge is attached, that is, the regulation groove 2*a* and the regulated portion 61, but they can be arranged collectively. For example, it may be possible to extend the guide groove 1*c* to reach the area of the cutout portion 1*d* according to the present embodiment to enable the protruded portion 74 to be engaged to the guide groove 1*c* even in the state where the cartridge is attached.

Removal of Cartridge

The photoconductor cartridge B and the developing cartridge C can be removed from the apparatus body A by performing a removal operation of carrying out the steps of attachment operation described above in reverse order. In order to remove the developing cartridge C, the operator draws out the tray 18 to an opposite direction to the insertion direction D in a state where the door 13 of the apparatus body A is opened. Then, the first support hole 23*a* and the second support hole 23*b* are withdrawn from the coupling pins 69 and 69 and engagement between the developing cartridge C and the photoconductor cartridge B is cancelled. Further, the developing coupling 21 is withdrawn from the second drive shaft 99 of the apparatus body A. By lifting up the developing cartridge C from the tray 18 in a state where the tray 18 is drawn out to the predetermined position, removal of the developing cartridge C is completed. Thereafter, the operator may further remove the photoconductor cartridge B or set a new developing cartridge C to the tray 18 so that only the developing cartridge C is replaced.

In the present embodiment, service life of the photoconductor cartridge B is set longer than an average period of time for toner sealed in a new developing cartridge C to be consumed. Therefore, only the developing cartridge C can be replaced if there is no need to replace the photoconductor cartridge B.

When removing the photoconductor cartridge B, the operator draws out the photoconductor cartridge B to a direction opposite to the insertion direction D in a state where the developing cartridge C has been removed. Then, the photoconductor cartridge B is withdrawn from the drive shaft support member 1 and the non-drive side support member 12 on the apparatus body A, and the drum coupling 70 is withdrawn from the first drive shaft 14. Thereafter, the cartridge is drawn out further along the guide members 19*a* and 19*b*, by which the removal of the photoconductor cartridge B from the apparatus body A is completed.

Conveyance of Waste Toner

Figure 17A:
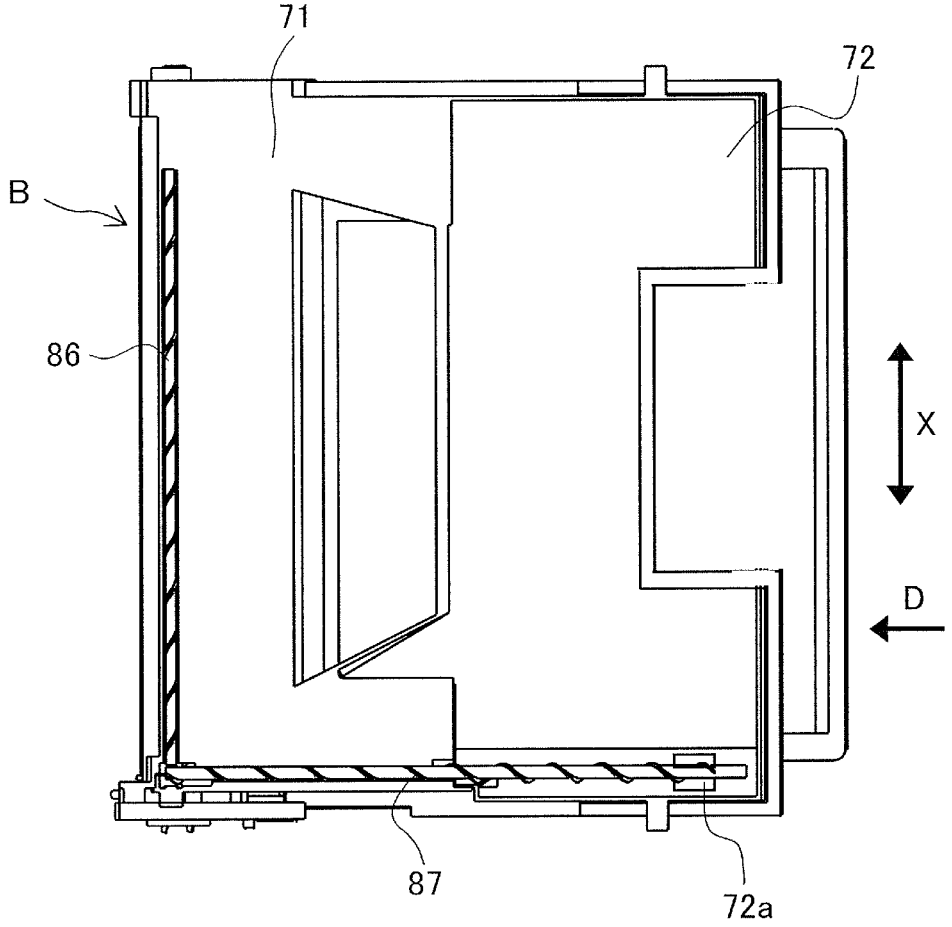
FIG. 17A is a cross-sectional view of the photoconductor cartridge according to the first embodiment.
Figure 17B:
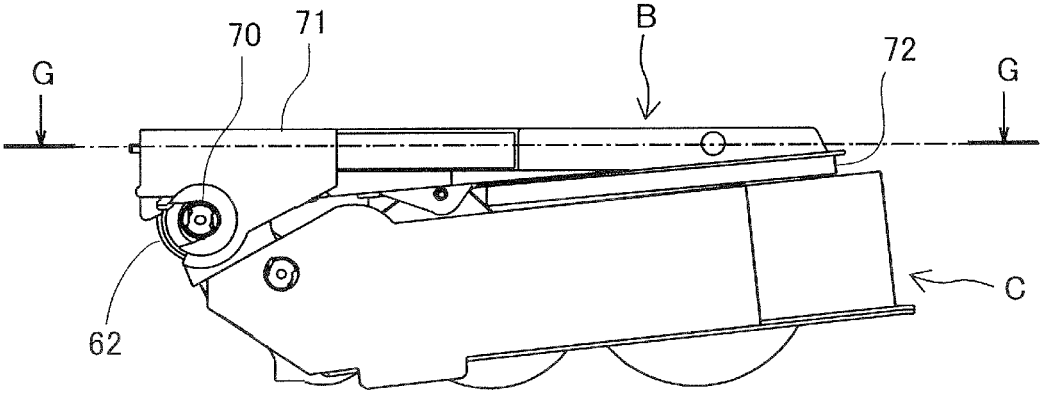
FIG. 17B is a side view of the photoconductor cartridge according to the first embodiment.

Next, a configuration for conveying waste toner collected by the cleaning member from the photosensitive drum will be explained. FIG. 17A is a cross-sectional view taken at cut line G-G of FIG. 17B to illustrate an inner structure of the photoconductor cartridge B. As illustrated in FIG. 17A, waste toner removed by the cleaning member 77 (refer to FIG. 2) from the surface of the photosensitive drum 62 is conveyed by a first screw 86 and a second screw 87 arranged on an inner side of the photoconductor cartridge B. The first screw 86 and the second screw 87 are conveyance members for conveying the waste from the photoconductor according to the present embodiment.

The first screw 86 is arranged near the photosensitive drum 62 and the cleaning member 77 so that a rotational axis thereof extends in the reference axis direction X (refer to FIG. 2), and it conveys waste toner to the drive side in the reference axis direction X. The second screw 87 is arranged inside the photoconductor cartridge B, and is laid in a direction intersecting the first screw 86 at an end portion on a downstream side in a conveyance direction of the first screw 86. The first screw 86 receives driving force from the above-described drum coupling 70 and rotates, and the second screw 87 receives driving force from the first screw 86 and rotates. As described in further detail in the third embodiment, the first screw 86 and/or the second screw 87 may receive driving force from the developing coupling 21 and rotate.

A waste toner discharge port 72*a* serving as a first opening portion capable of discharging waste toner to the developing cartridge C is provided on the lid member 72. The waste toner discharge port 72*a* is provided at a position opposing to a downstream portion of the second screw 87 in the conveyance direction of the second screw 87. Waste toner removed from the photosensitive drum 62 by the cleaning member 77 is first conveyed by the first screw 86 along the reference axis direction X, then conveyed by the second screw 87 to the waste toner discharge port 72*a* and discharged to an exterior of the photoconductor cartridge B.

Figure 26:
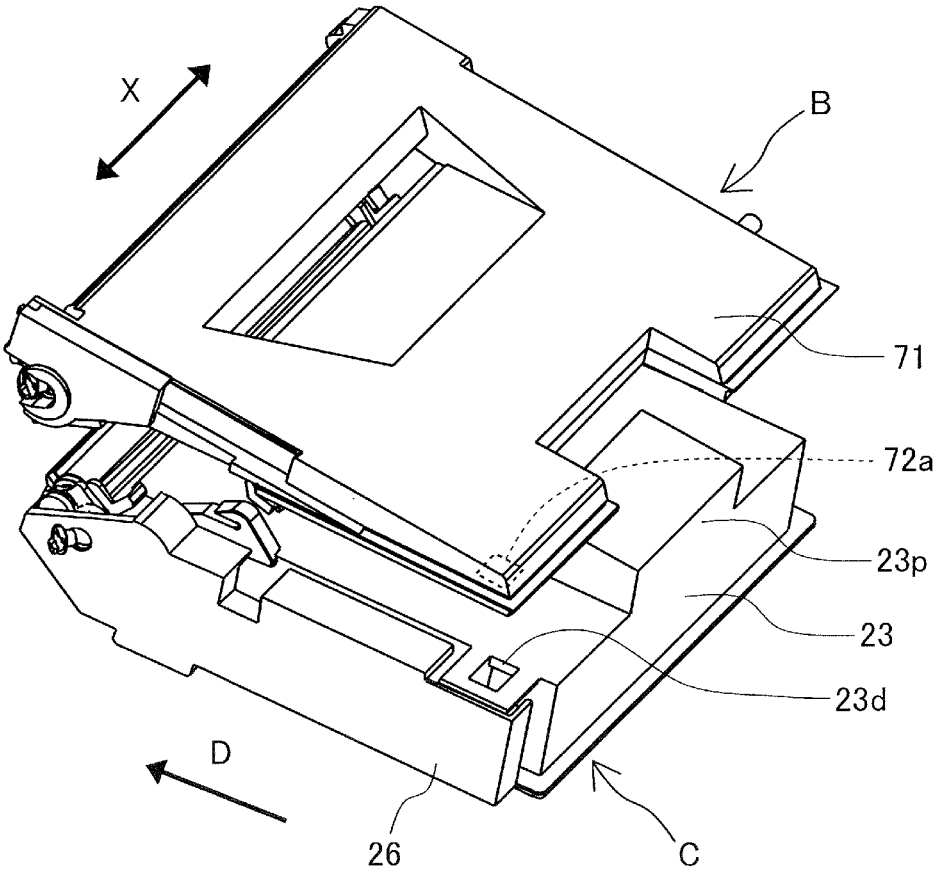
FIG. 26 is a view illustrating a mechanism for transferring waste toner between cartridges according to the first embodiment.
Figure 27A:
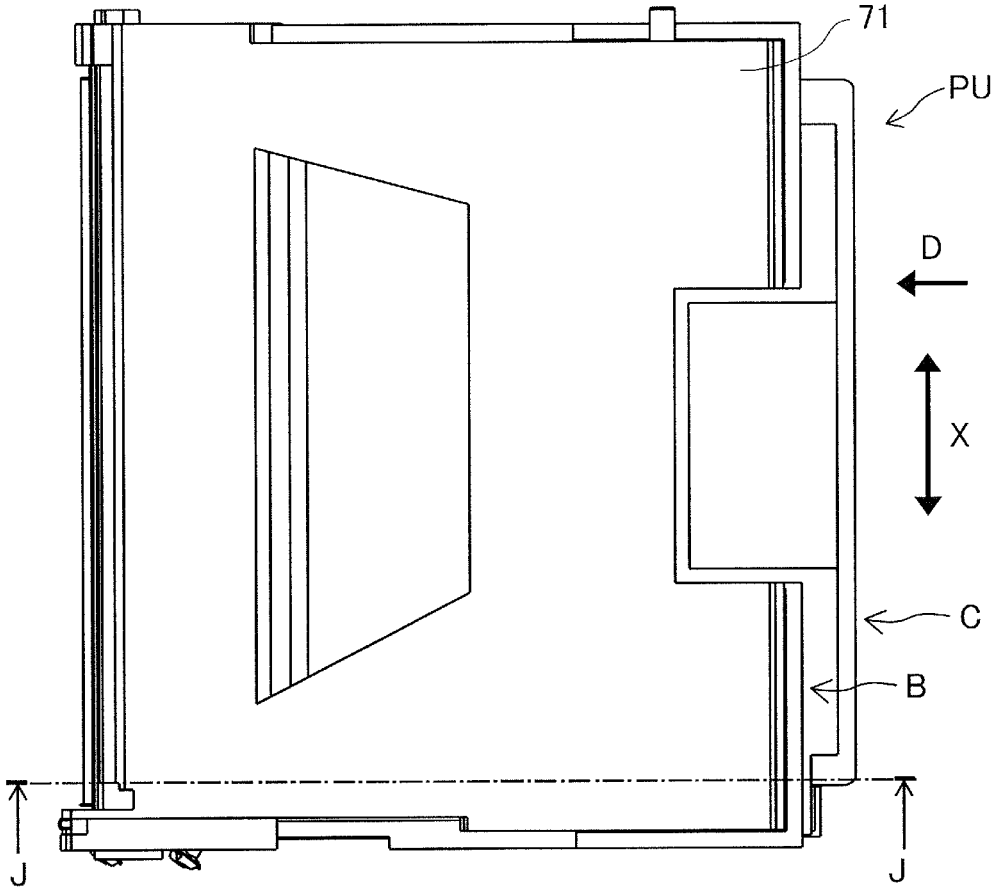
FIG. 27A is a cross-sectional view of the process unit according to the first embodiment.
Figure 27B:
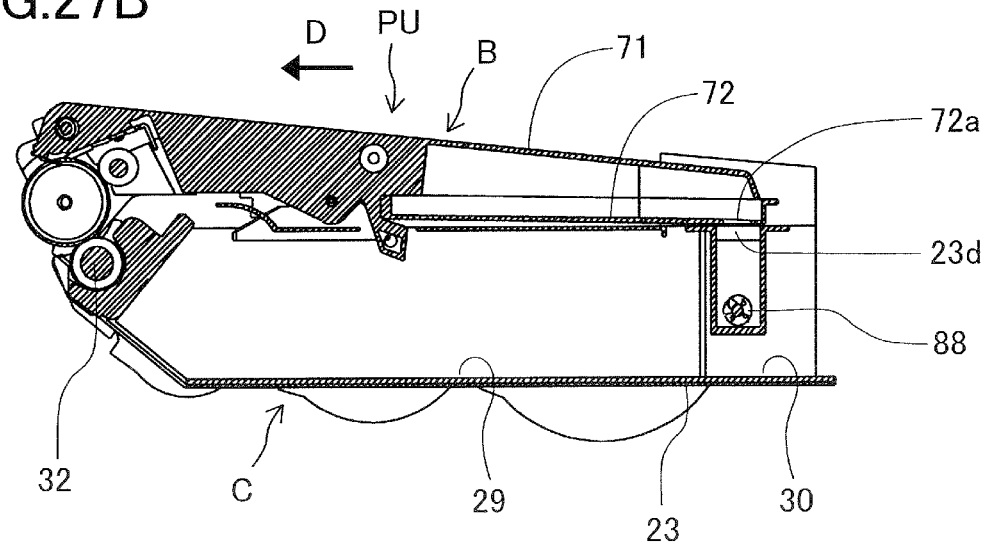
FIG. 27B is a side view of the process unit according to the first embodiment.

FIG. 26 is a perspective view illustrating a positional relationship between the photoconductor cartridge B and the developing cartridge C, and FIG. 27B is a cross-sectional view in which the process unit PU is cut at a cut line J-J of FIG. 27A. As illustrated in FIGS. 26 and 27B, a waste toner receiving port 23*d* serving as a second opening portion for receiving waste toner is provided on an upper surface of the developer container 23 at a position opposed to the waste toner discharge port 72*a*. Further, the waste toner chamber 30 serving as a storage portion for storing waste toner is provided in the developer container 23 at a position upstream of the toner chamber 29 with respect to the insertion direction D of the cartridge, that is, at an end portion distant from the developing roller 32. Waste toner discharged from the waste toner discharge port 72*a* passes through the waste toner receiving port 23*d* and flows into the waste toner chamber 30 of the developing cartridge C.

Figure 28A:
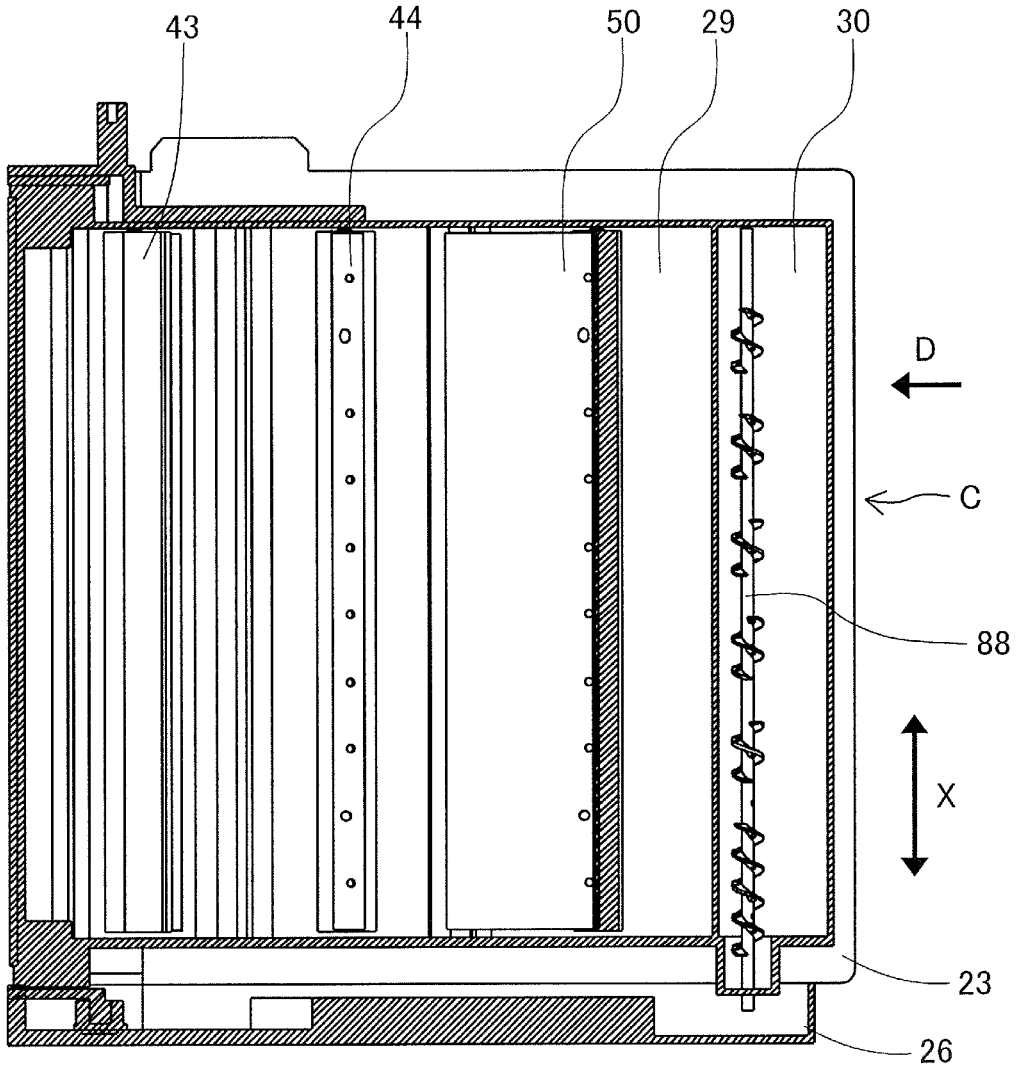
FIG. 28A is a cross-sectional view of the process unit according to the first embodiment.
Figure 28B:
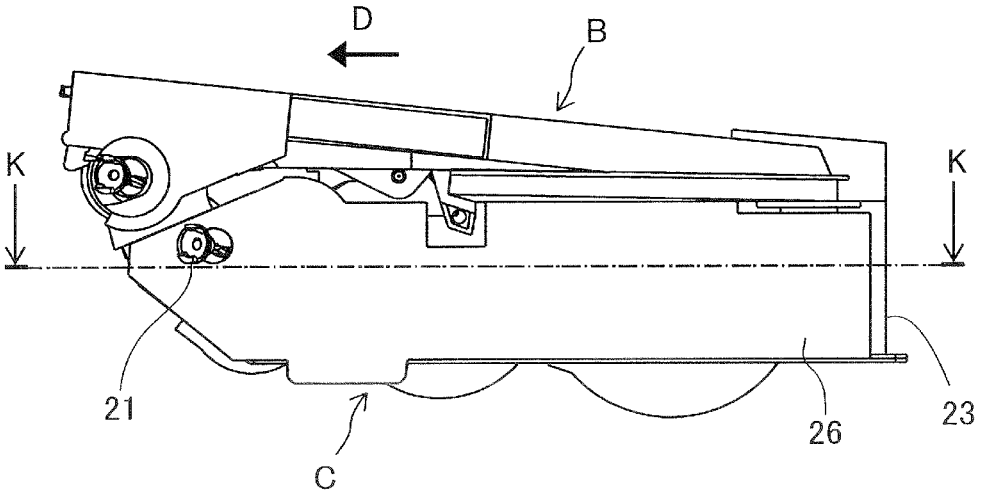
FIG. 28B is side view of the process unit according to the first embodiment.

FIG. 28A is a cross-sectional view of the developing cartridge C cut at a cut line K-K of FIG. 28B. As illustrated in FIGS. 27 and 28, a third screw 88 is provided on the waste toner chamber 30. The third screw 88 is arranged inside the waste toner chamber 30 that extends in the reference axis direction X so that an axial direction of the third screw 88 corresponds to the reference axis direction X, that is, so that it is arranged substantially in parallel with the first screw 86. Further, the third screw 88 is rotated by receiving driving force transmitted from the developing coupling 21 via a gear train not shown. According to the above-described configuration, waste toner flowing from the photoconductor cartridge B through the waste toner receiving port 23*d* to the waste toner chamber 30 of the developing cartridge C is conveyed as required in the reference axis direction X by the third screw 88 and filled in the waste toner chamber 30.

Further, a shutter not shown is provided respectively on the waste toner discharge port 72*a* of the photoconductor cartridge B and the waste toner receiving port 23*d* of the developing cartridge C. In a state where the photoconductor cartridge B and the developing cartridge C are attached to the apparatus body A, the shutters are in an opened state, so that the waste toner discharge port 72*a* and the waste toner receiving port 23*d* are communicated. In a state where the photoconductor cartridge B and the developing cartridge C are separated, such as when the developing cartridge C is removed from the apparatus body A, both shutters are closed to prevent waste toner from leaking to the exterior.

An actual configuration example of such shutter mechanism will be described below. A shutter member capable of sliding in the insertion direction D is arranged on the casing of each cartridge, and an urging member for urging each shutter to a position closing the opening portion is arranged. Then, during an insertion operation of the developing cartridge C, a portion of the developing cartridge C slides the shutter of the photoconductor cartridge B in the insertion direction D to open the waste toner discharge port 72*a*. Along therewith, a portion of the photoconductor cartridge B may slide the shutter of the developing cartridge C to a direction opposite to the insertion direction D to open the waste toner receiving port 23*d*. As for the waste toner receiving port 23*d* of the developing cartridge C that faces upward, it may be in an opened state without providing a shutter thereto.

Second Embodiment

Next, an image forming apparatus according to a second embodiment will be described. The present embodiment differs from the first embodiment in that a photoconductor cartridge is inserted to the apparatus body in a state supported by a drawer member other than the tray 18 described above. Components having a similar configuration and effect as those of the first embodiment are denoted with the same reference numbers as the first embodiment, and descriptions thereof are omitted.

Figure 29:
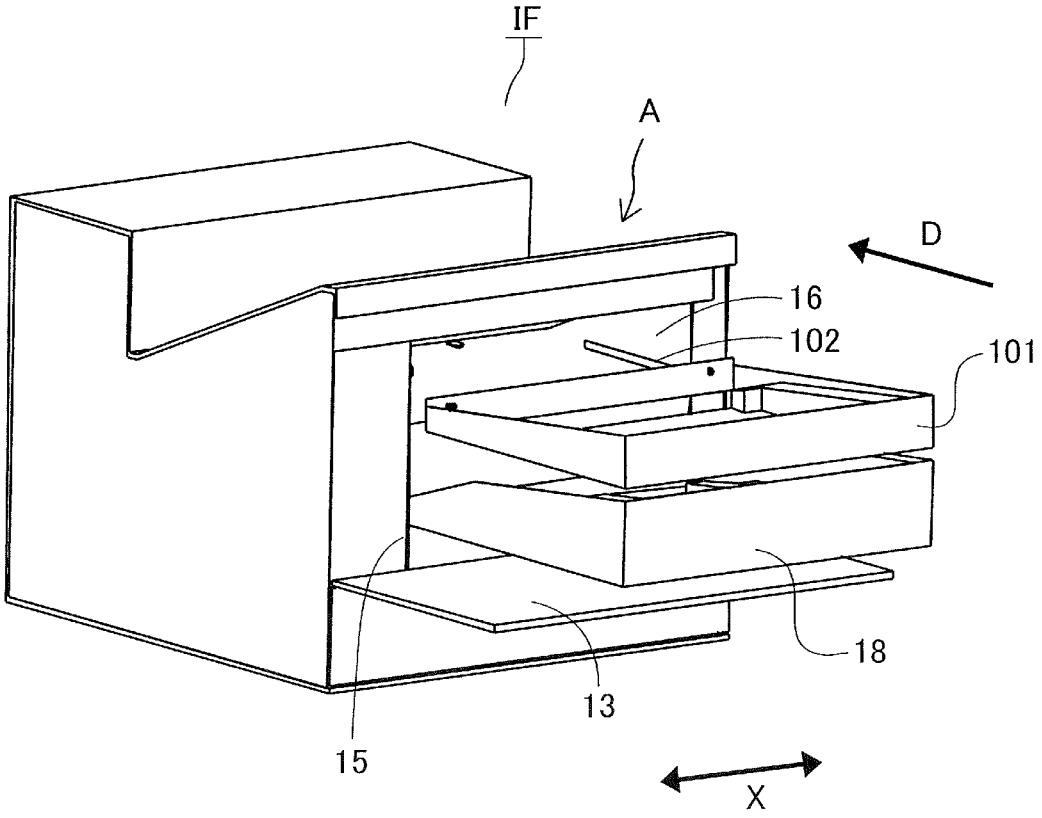
FIG. 29 is perspective view of an apparatus body and a tray of an image forming apparatus according to a second embodiment.

As illustrated in FIG. 29, an upper tray 101 that supports a photoconductor cartridge B is provided above a tray 18, i.e., lower tray, supporting the developing cartridge C in an image forming apparatus IF according to the present embodiment. The upper tray 101 is another example of a guide unit that guides attachment and detachment of the photoconductor cartridge B with respect to the apparatus body A. The upper tray 101 is supported by a guide rail 102 provided on the apparatus body A and inserted to and drawn out of the apparatus body A along the insertion direction D of the cartridge.

Figure 30A:
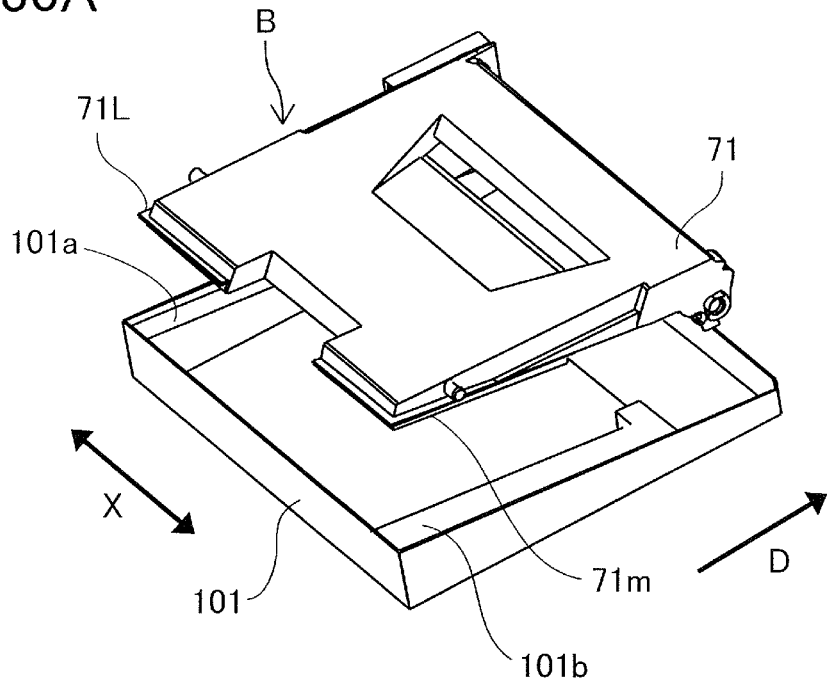
FIG. 30A is a perspective view of a photoconductor cartridge and an upper tray according to the second embodiment.
Figure 30B:
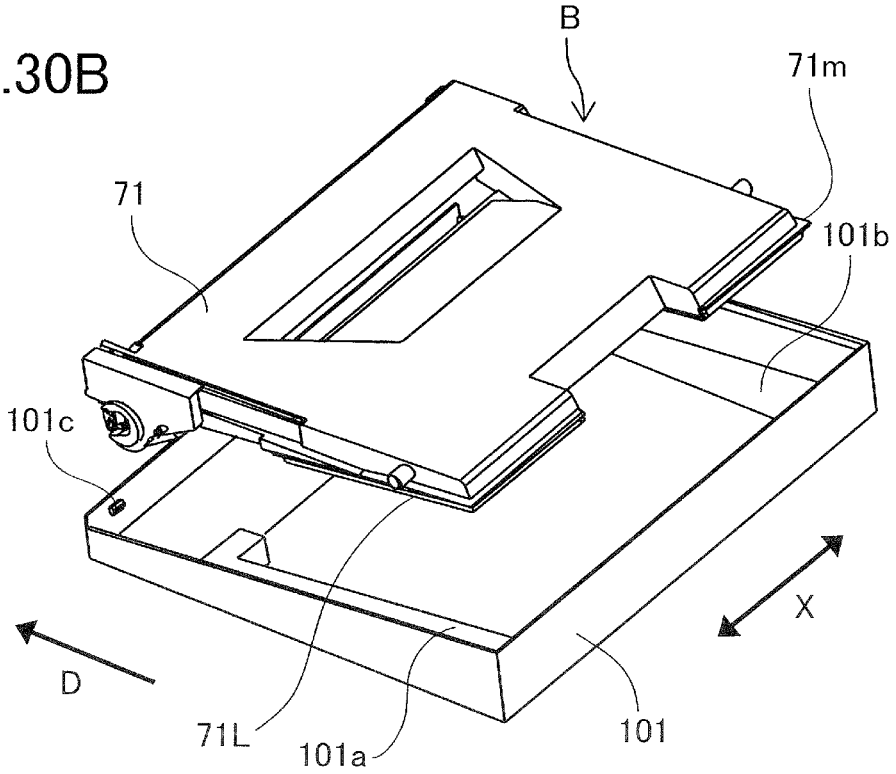
FIG. 30B is a perspective view of the photoconductor cartridge and the upper tray according to the second embodiment.

As illustrated in FIGS. 30A and 30B, the photoconductor cartridge B includes a supported surface 71L on a drive side and a supported surface 71*m* on a non-drive side in the reference axis direction X, and the upper tray 101 includes supporting surfaces 101*a* and 101*b* that respectively support the supported surfaces 71L and 71*m*. Further, the upper tray 101 includes a regulation portion 101*c* that regulates movement of the photoconductor cartridge B with respect to the insertion direction D at a wall surface of the cartridge at a downstream side in the insertion direction D.

Figure 31:
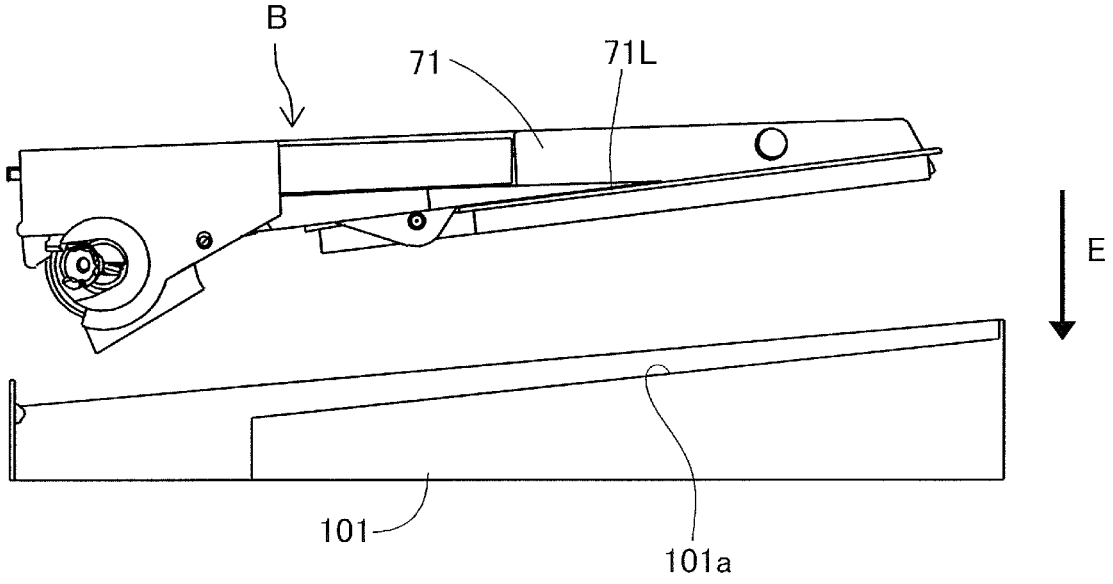
FIG. 31 is a view illustrating a state of operation in which the photoconductor cartridge is loaded on the upper tray according to the second embodiment.
Figure 32:
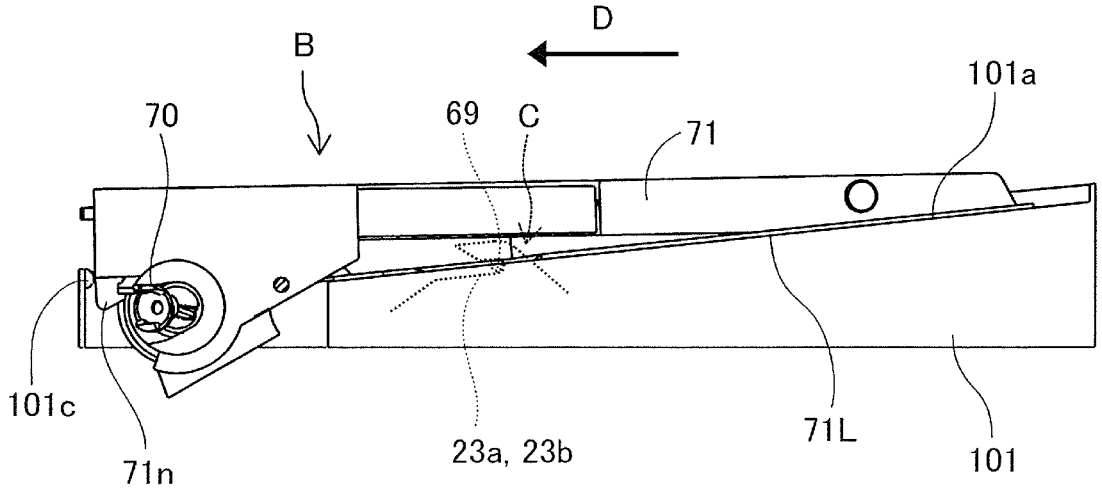
FIG. 32 is a view illustrating a state of operation in which the photoconductor cartridge is loaded on the upper tray according to the second embodiment.

FIGS. 31 and 32 illustrate a state in which the operation for supporting the photoconductor cartridge B on the upper tray 101 is viewed from a drive side in the reference axis direction X. The operation on the drive side will be described in the following description, but a similar operation is performed on the non-drive side.

As illustrated in FIG. 31, the photoconductor cartridge B is set from above to the tray 101 drawn out to a predetermined position where attaching and detaching of the photoconductor cartridge B to and from the apparatus body A is enabled. The operator places the cartridge from above the upper tray 101 downward while holding the holding part of the photoconductor cartridge B (arrow E). Then, as illustrated in FIG. 32, the supported surface 71L of the photoconductor cartridge B contacts a supporting surface 101*a* of the upper tray 101 and is supported thereby. Further, a regulated portion 71*n* provided on an end face on a downstream side in the insertion direction D of the photoconductor cartridge B contacts the regulation portion 101*c* of the upper tray 101, by which the photoconductor cartridge B is supported by the upper tray 101.

The operation of attaching the photoconductor cartridge B and the developing cartridge C to the apparatus body A that follows is the same as the first embodiment. That is, by inserting the upper tray 101 supporting the photoconductor cartridge B to the apparatus body A toward the insertion direction D, the drum coupling 70 is connected to the first drive shaft 14 of the apparatus body A (FIGS. 23A and 23B). Further, the protruded portion 74 of the photoconductor cartridge B fits to the guide groove 1*c* of the drive shaft support member 1, and thereafter, the regulated portion 61 fits to the regulation groove 2*a* of the regulation member 2, by which the positioning in the reference axis direction X during and after attachment is realized (FIGS. 24 and 25).

Further, if the developing cartridge C is inserted to the apparatus body A in a state where the photoconductor cartridge B is attached to the apparatus body A, the first support hole 23*a* and the second support hole 23*b* of the developing cartridge C fit to the coupling pins 69 and 69 of the photoconductor cartridge B (FIG. 32). Thereby, the developing cartridge C is supported on the photoconductor cartridge B. An opening portion is formed on the bottom side of the upper tray 101 to realize fitting of the coupling pins 69 and 69 to the first support hole 23*a* and the second support hole 23*b*. When the developing cartridge C is inserted to the attachment position, the developing coupling 21 is connected to the second drive shaft 99, by which the waste toner discharge port 72*a* of the photoconductor cartridge B and the waste toner receiving port 23*d* of the developing cartridge C are communicated.

According to the present embodiment, the attachment and detachment of the photoconductor cartridge B and the developing cartridge C are performed in a state where the cartridges are supported by trays (18 and 101). By inserting the tray 18 supporting the developing cartridge C in a direction intersecting the reference axis direction X, that is, in the insertion direction D, the developing cartridge C is engaged with the photoconductor cartridge B attached to the apparatus body A. That is, even according to the configuration of the present embodiment, the replacement operation of the cartridges is facilitated in a configuration where the image forming unit is composed of a plurality of cartridges, and an image forming unit and an image forming apparatus having a high usability can be provided.

Third Embodiment

Next, an image forming apparatus according to a third embodiment will be described. Configurations similar to the first and second embodiments are denoted with the same reference numbers as the first and second embodiments, and descriptions thereof are omitted.

Figure 33:
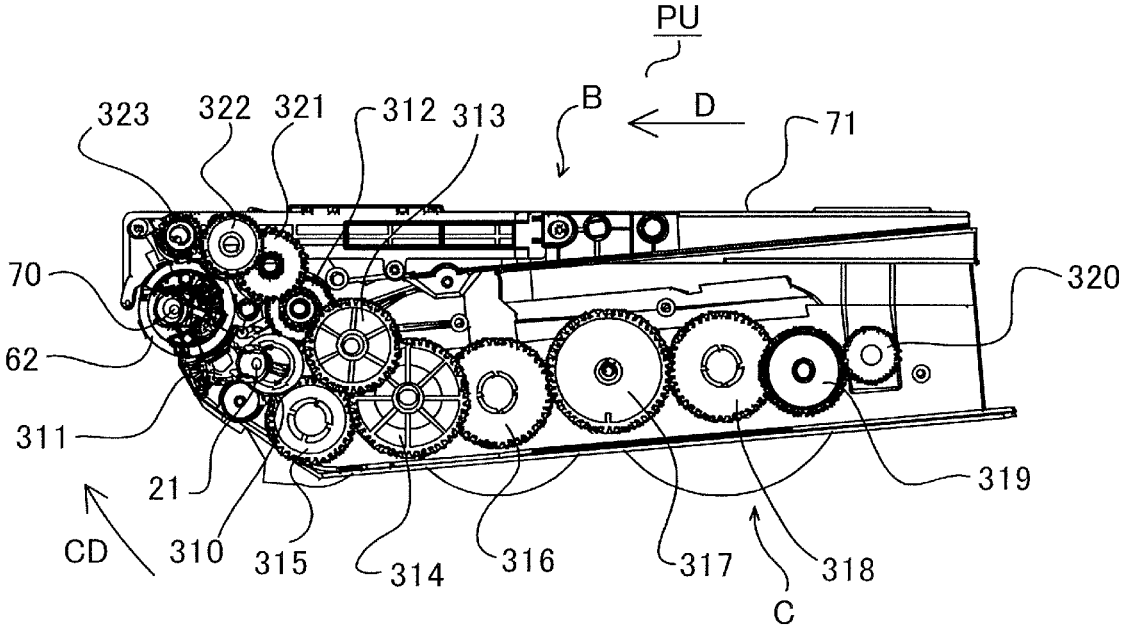
FIG. 33 is a side view of a photoconductor cartridge and a developing cartridge according to a third embodiment.
Figure 34:
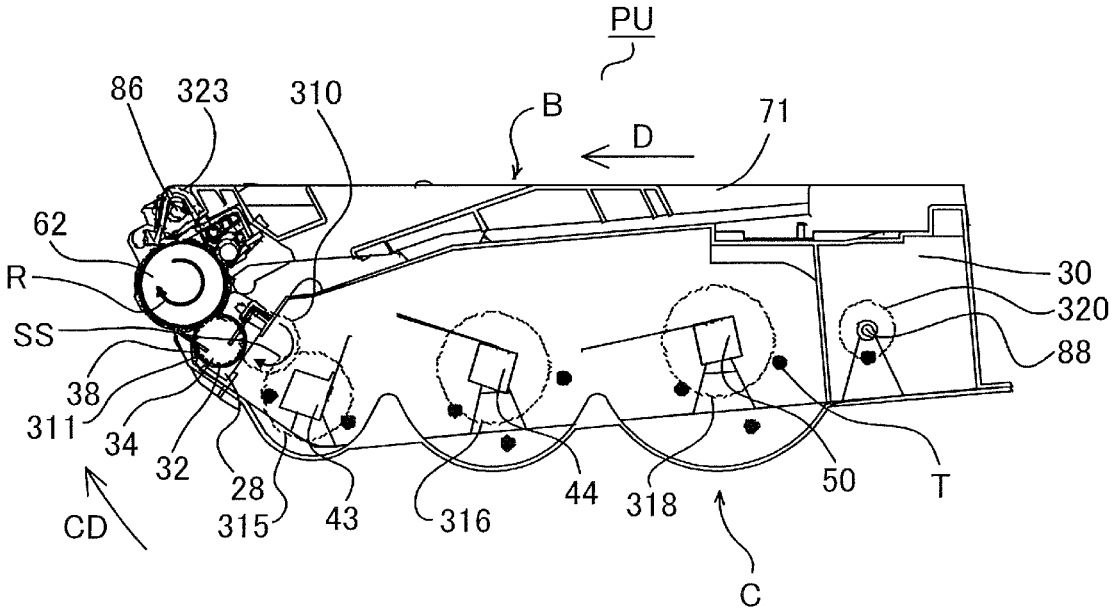
FIG. 34 is a cross-sectional view of the photoconductor cartridge and the developing cartridge according to a third embodiment.

First, drive transmission between a photoconductor cartridge B serving as a first cartridge and a developing cartridge C serving as a second cartridge according to the present embodiment will be described with reference to FIGS. 33 and 34. FIG. 33 is a side view of the photoconductor cartridge B and the developing cartridge C. A driven-side side member 26 (FIG. 18) of the developing cartridge C and a drum bearing 73 (FIG. 18) of the photoconductor cartridge B are not shown, so as to illustrate the configuration related to drive transmission. FIG. 34 is a cross-sectional view of the photoconductor cartridge B and the developing cartridge C.

As described earlier, the process unit PU is detachably attached to the apparatus body A, and includes the photoconductor cartridge B and the developing cartridge C. The photoconductor cartridge B and the developing cartridge C are inserted to the apparatus body A.

The driving force from the apparatus body A is transmitted via a first drive shaft 14 (refer to FIGS. 22 to 23D) to a drum coupling 70, which corresponds to a first input portion, and transmitted via a second drive shaft 99 to a developing coupling 21, which corresponds to an input portion or a second input portion. Thereby, the developing roller 32 and the photosensitive drum 62 respectively rotate. In other words, the drum coupling 70 and the developing coupling 21 are configured to receive drive from the apparatus body A.

The developing cartridge C includes a developing coupling gear 310 that rotates integrally with the developing coupling 21. The developing coupling gear 310 is configured to be coaxial with the developing coupling 21 in a state in which the developing coupling 21 is engaged with the second drive shaft 99.

A developing roller gear 311 is attached to the developing roller 32. A first conveyance gear 315 is attached to the first conveyance member 43. A second conveyance gear 316 is attached to the second conveyance member 44. A third conveyance gear 318 is attached to the third conveyance member 50. A third screw gear 320 is attached to the third screw 88.

Further, the developing cartridge C includes a first idler gear 312, i.e., drive transmission portion according to the present embodiment, meshed with the developing coupling gear 310, a second idler gear 313 meshed with the first idler gear 312, and a third idler gear 314 meshed with the second idler gear 313. The third idler gear 314 is meshed with the first conveyance gear 315 and the second conveyance gear 316. Further, the developing cartridge C includes a fourth idler gear 317 meshed with the second conveyance gear 316 and the third conveyance gear 318, and a fifth idler gear 319 meshed with the third conveyance gear 318 and the third screw gear 320. The first idler gear 312 is rotatable around a rotational axis, i.e., second rotational axis. The rotational axis directions of the respective gears are parallel.

Meanwhile, in the photoconductor cartridge B, a first screw gear 323 is attached to the first screw 86. Further, the photoconductor cartridge B includes a driven gear 321, i.e., driven portion according to the present embodiment, meshed with the first idler gear 312, and an intermediate gear 322 meshed with the driven gear 321 and the first screw gear 323. The driven gear 321 is rotatable around a rotational axis, i.e., first rotational axis.

The drum coupling 70 receives drive from the apparatus body A and rotates in an arrow R direction together with the photosensitive drum 62. The photosensitive drum 62 is configured to transmit drive to the transfer roller 7 (refer to FIG. 1) of the apparatus body A.

Further, the developing coupling gear 310 rotates in an arrow SS direction of FIG. 34, which is a same direction of rotation as the developing coupling 21 in a state where the developing coupling 21 rotates by receiving drive from the apparatus body A. In a state where the developing coupling gear 310 rotates, the first idler gear 312 and the developing roller gear 311 provided in the developing cartridge C rotates. In a state where the developing roller gear 311 rotates, the developing roller 32 rotates in a same direction as the developing roller gear 311.

Driving force is transmitted sequentially from the first idler gear 312 to the second idler gear 313 and the third idler gear 314. In a state where the third idler gear 314 rotates, the first conveyance gear 315 and the second conveyance gear 316 rotate. Driving force is further transmitted from the second conveyance gear 316 to the fourth idler gear 317, the third conveyance gear 318, the fifth idler gear 319 and the third screw gear 320. Thereby, driving force is transmitted from the apparatus body A to the developing roller gear 311, the first conveyance member 43, the second conveyance member 44, the third conveyance member 50 and the third screw 88.

As described earlier, the developing cartridge C is capable of being separated from the photoconductor cartridge B. Further, the developing cartridge C is attached to and detached from the apparatus body A in a state where the photoconductor cartridge B has been attached to the apparatus body A. More specifically, the first support hole 23*a* and the second support hole 23*b* of the developing cartridge C are engaged with the coupling pin 69 provided on the cleaning frame member 71. Thereby, the developing cartridge C is coupled to the photoconductor cartridge B.

In a state where the photoconductor cartridge B and the developing cartridge C are attached to the apparatus body A, the first idler gear 312 is directly meshed with the driven gear 321 provided in the photoconductor cartridge B. The first idler gear 312 transmits the driving force that the developing coupling 21 receives from the apparatus body A to the driven gear 321.

The driving force transmitted to the driven gear 321 rotates the intermediate gear 322 and is transmitted via the intermediate gear 322 to the first screw gear 323. Then, the first screw gear 323 and the first screw 86 rotate.

In other words, according to the present embodiment, the first screw 86 serving as an example of a rotary member is rotated by the driving force input to the developing coupling 21.

Meanwhile, the photosensitive drum 62 provided on the photoconductor cartridge B similarly as the first screw 86 is rotated by the driving force transmitted to the drum coupling 70, as described earlier. In other words, both a member, e.g., the photosensitive drum 62, that rotates by driving force transmitted via the first input portion and a member, e.g., the first screw 86, that rotates by driving force transmitted via the second input portion provided on the second cartridge exist in the first cartridge according to the present embodiment.

As mentioned earlier, the second screw 87 rotates by receiving driving force from the first screw 86. Waste toner removed by the cleaning member 77 from the photosensitive drum 62 is first conveyed by the first screw 86 along the reference axis direction X and thereafter conveyed by the second screw 87 to the waste toner discharge port 72*a*, before being discharged to the exterior of the photoconductor cartridge B.

Method for Engaging Driven Gear and First Idler Gear

Next, a method for engaging the driven gear 321 of the photoconductor cartridge B and the first idler gear 312 of the developing cartridge C will be described with reference to FIGS. 35A and 35B.

Figure 35A:
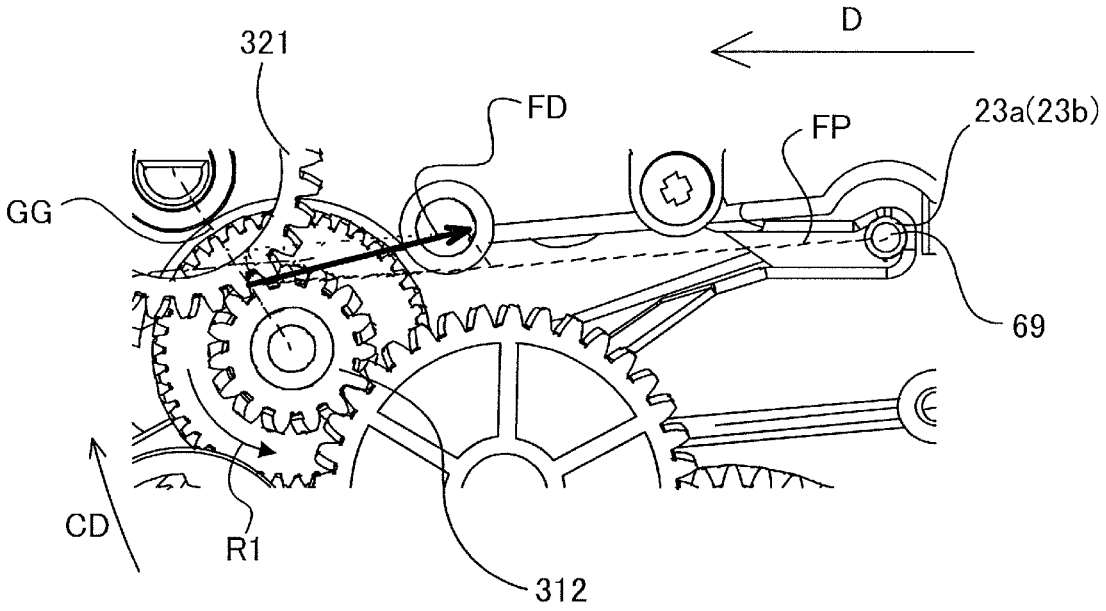
FIG. 35A is a view illustrating an engagement of a first idler gear and a driven gear according to the third embodiment.
Figure 35B:
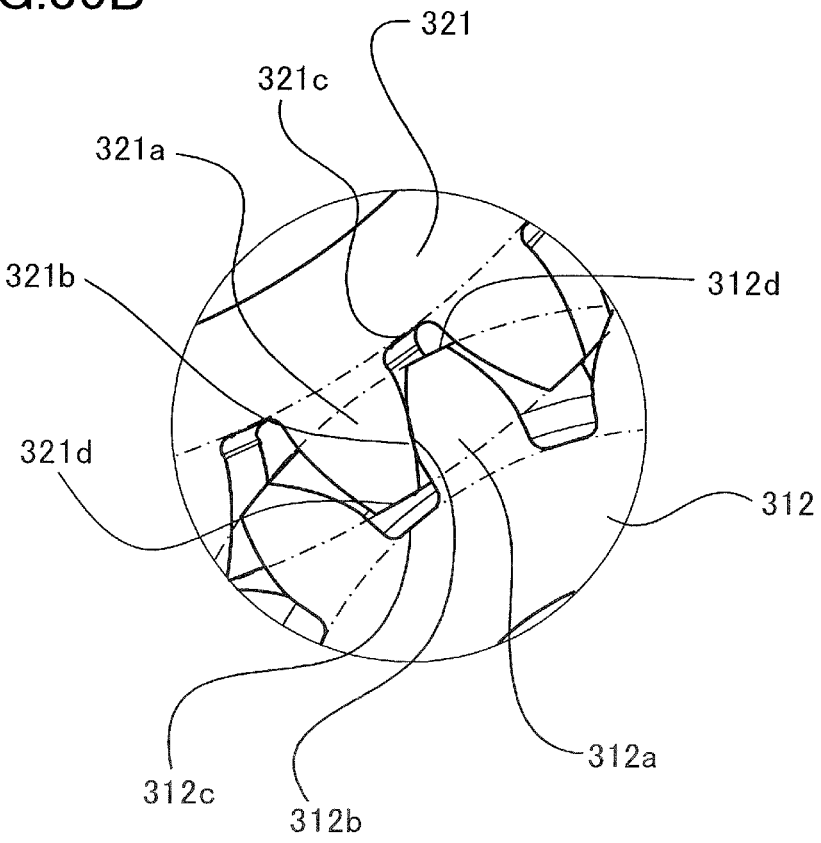
FIG. 35B is a view illustrating an engagement of the first idler gear and the driven gear according to the third embodiment.

FIGS. 35A and 35B are view illustrating engagement of the first idler gear 312 and the driven gear 321. FIG. 35A is a partial view illustrating engagement of the first idler gear 312 and the driven gear 321, and FIG. 35B is an enlarged view illustrating engagement of the first idler gear 312 and the driven gear 321.

As described in the first embodiment, the developing cartridge C moves in the direction of arrow D and is inserted in the apparatus body A. The developing cartridge C is supported by the apparatus body A via the photoconductor cartridge B. More specifically, the insertion direction D, that is, direction of attachment, of the developing cartridge C is a direction intersecting a rotational axis of the first idler gear 312. In the present embodiment, the direction of insertion of the developing cartridge C is a direction orthogonal to the rotational axis of the first idler gear 312. Further, the direction of attachment, i.e., direction of insertion, of the photoconductor cartridge B is a direction intersecting the rotational axis of the driven gear 321. In the present embodiment, the direction of attachment of the photoconductor cartridge B is a direction orthogonal to the rotational axis of the driven gear 321. Further, the rotational axis of the first idler gear 312 is parallel to the rotational axis of the driven gear 321. Further, the rotational axis direction of the first idler gear 312 is in parallel with the rotational axis direction of the developing roller 32. Further, the rotational axis direction of the first idler gear 312 is parallel with the direction of a pivot axis of the developing cartridge C described later.

As described earlier, in a state where the developing cartridge C is inserted to the apparatus body A, the first support hole 23*a* and the second support hole 23*b* of the developing cartridge C is engaged with the coupling pin 69 provided on the cleaning frame member 71, and the developing cartridge C is coupled to the photoconductor cartridge B. The developing cartridge C is supported pivotably in an arrow CD direction by the photoconductor cartridge B. Further, when the developing cartridge C pivots in the arrow CD direction around the coupling pin 69, the gap retainer 38 (refer to FIGS. 19 and 34) provided on the developing roller 32 contacts the photosensitive drum 62.

Thereby, the position of the developing cartridge C with respect to the photoconductor cartridge B is regulated in a direction orthogonal to the rotational axis direction of the first idler gear 312.

In this state, as illustrated in FIGS. 35A and 35B, the first idler gear 312 provided on the developing cartridge C is positioned at a position engaged with the driven gear 321 provided on the photoconductor cartridge B. Thereby, teeth 312*a* of the first idler gear 312 will be meshed with teeth 321*a* of the driven gear 321.

In a state where the developing cartridge C is attached in the arrow D direction, the first idler gear 312 of the developing cartridge C is engaged with the driven gear 321. In the present embodiment, at least a part of the driven gear 321 is exposed from the photoconductor cartridge B toward the upstream side in the insertion direction D, i.e., attachment direction, of the developing cartridge C. Further, at least a portion of the first idler gear 312 is exposed from the developing cartridge C toward the downstream side in the insertion direction D of the developing cartridge C. Further, with respect to the insertion direction D of the developing cartridge C, a center of rotation, i.e., rotational axis, of the driven gear 321 is positioned downstream of the center of rotation, i.e., rotational axis, of the first idler gear 312. Thereby, in a state where the developing cartridge C is inserted in the arrow D direction, the first idler gear 312 of the developing cartridge C is engaged smoothly with the driven gear 321.

As illustrated in FIG. 35A, the first idler gear 312 receives driving force from the developing coupling gear 310 and rotates in an arrow R1 direction, transmitting driving force to the driven gear 321. Then, the first idler gear 312 receives a force FD from the driven gear 321 as reaction to a pressure angle direction.

In the arrow CD direction, that is, the direction in which the developing roller 32 approaches the photosensitive drum 62, the direction of force FD should preferably be directed toward the downstream side of a line FP connecting an action part of force FD and a center of the coupling pin 69. The action part of force FD represents a portion in which tooth surfaces 312*b* of the first idler gear 312 contact tooth surfaces 321*b* of the driven gear 321. If the direction of force FD satisfies the above-described relationship, the force FD generated by the mutual pushing of the tooth surfaces 312*b* and 321*b* when the first idler gear 312 rotates the driven gear 321 causes a moment in the arrow CD direction to act on the developing cartridge C. Therefore, the gap retainer 38 of the developing cartridge C can be abutted against the photosensitive drum 62 more securely. Similar to the first embodiment, the developing cartridge C can be urged toward the arrow CD direction by the urging member 100 (FIG. 14) provided on the tray 18. In this case, in a state where the first idler gear 312 rotates the driven gear 321, both the urging force of the urging member 100 and the force FD by meshing of gears act as force to abut the gap retainer 38 of the developing cartridge C against the photosensitive drum 62.

As illustrated in FIG. 35B, a gap, i.e., backlash, should preferably be formed between tooth tip surfaces 312*d* (i.e., top lands) of the teeth 312*a* of the first idler gear 312 and bottom surfaces (i.e., bottom lands) 321*c* of the driven gear 321. Similarly, a gap, i.e., backlash, should preferably be formed between tooth tip surfaces 321*d* (i.e., top lands) of the teeth 321*a* of the driven gear 321 and bottom surfaces 312*c* (i.e., bottom lands) of the first idler gear 312. In other words, a gap is formed between the tip circle (i.e., addendum circle) of the first idler gear 312 and the root circle of the driven gear 321 when viewed in the rotational axis direction of the first idler gear 312, that is, in the direction parallel to the rotational axis direction of the driven gear 321. Further, a gap is formed between the root circle of the first idler gear 312 and the tip circle (i.e., addendum circle) of the driven gear 321.

The position of the developing cartridge C with respect to the direction orthogonal to the rotational axis direction of the first idler gear 312 is determined by the first support hole 23*a* and the second support hole 23*b* engaging with the coupling pin 69 and the gap retainer 38 being in contact with the photosensitive drum 62. In other words, the developing cartridge C includes a position determined portion, that is, the first support hole 23*a*, the second support hole 23*b* and the gap retainer 38, with respect to the direction orthogonal to the rotational axis direction of the first idler gear 312. Further, the photoconductor cartridge B includes a position determining portion, that is, the coupling pin 69 and the photosensitive drum 62, with respect to the direction orthogonal to the rotational axis direction of the first idler gear 312.

In a direction orthogonal to the rotational axis direction of the first idler gear 312, in a state where the developing cartridge C is positioned, a gap is formed between the tooth tip surfaces 312*d* of the teeth 312*a* of the first idler gear 312 and the bottom surfaces 321*c* of the driven gear 321. Similarly, a gap is formed between the tooth tip surfaces 321*d* of the teeth 321*a* of the driven gear 321 and the bottom surfaces 312*c* of the first idler gear 312.

In other words, the process unit PU according to the present embodiment includes a restriction portion, that is, the coupling pin 69 and the photosensitive drum 62, that restricts movement of the developing cartridge C with respect to the direction orthogonal to the rotational axis of the first idler gear 312. The restriction portion contacts a restricted portion, that is, the first support hole 23*a*, the second support hole 23*b* and the gap retainer 38, of the developing cartridge C, and restricts movement of the developing cartridge C. More specifically, the restriction portion restricts movement of the developing cartridge C so that a gap is formed between the tip circle of the teeth 312*a* of the first idler gear 312 and the root circle of the driven gear 321 when viewed in the rotational axis direction of the first idler gear 312. Further, the restriction portion restricts movement of the developing cartridge C so that a gap is formed between the root circle of the first idler gear 312 and the tip circle of the driven gear 321 when viewed in the rotational axis direction of the first idler gear 312.

The first idler gear 312 and the driven gear 321 are positioned between a first restriction portion, i.e., the coupling pin 69, and a second restriction portion, i.e., the photosensitive drum 62, with respect to the direction orthogonal to the rotational axis of the first idler gear 312. The first idler gear 312 and the driven gear 321 are positioned between a first restricted portion, i.e., the first support hole 23*a* and the second support hole 23*b*, and a second restricted portion, i.e., the gap retainer 38.

Thereby, the driven gear 321 and the first idler gear 312 can be meshed stably. At the same time, the mutual positions of the photoconductor cartridge B and the developing cartridge C can be determined highly accurately. Further, the gap retainer 38 can be abutted against the photosensitive drum 62 stably.

Meanwhile, an angle, i.e., narrow angle, formed between a line GG that connects a rotational axis of the first idler gear 312 and a rotational axis of the driven gear 321 and a line FP should preferably be greater than 0° and smaller than 90°. The gap between the bottom surfaces 321*c* of the driven gear 321 can be secured more reliably if the line GG and the line FP are close to parallel. Further, the driven gear 321 and the first idler gear 312 can be meshed smoothly when the developing cartridge C is inserted if the line GG and the line FP are orthogonal. In the present embodiment, the angle, i.e., narrow angle, formed between line GG and line FP is set greater than 45°.

Further, the force required for the first idler gear 312 to rotate is greater than a force required for the driven gear 321 to rotate. If the driven gear 321 and the first idler gear 312 abut against each other during insertion of the developing cartridge C, the driven gear 321 rotates. As a result, rotation of the developing roller 32 can be prevented.

Conveyance of Waste Toner

Figure 36:
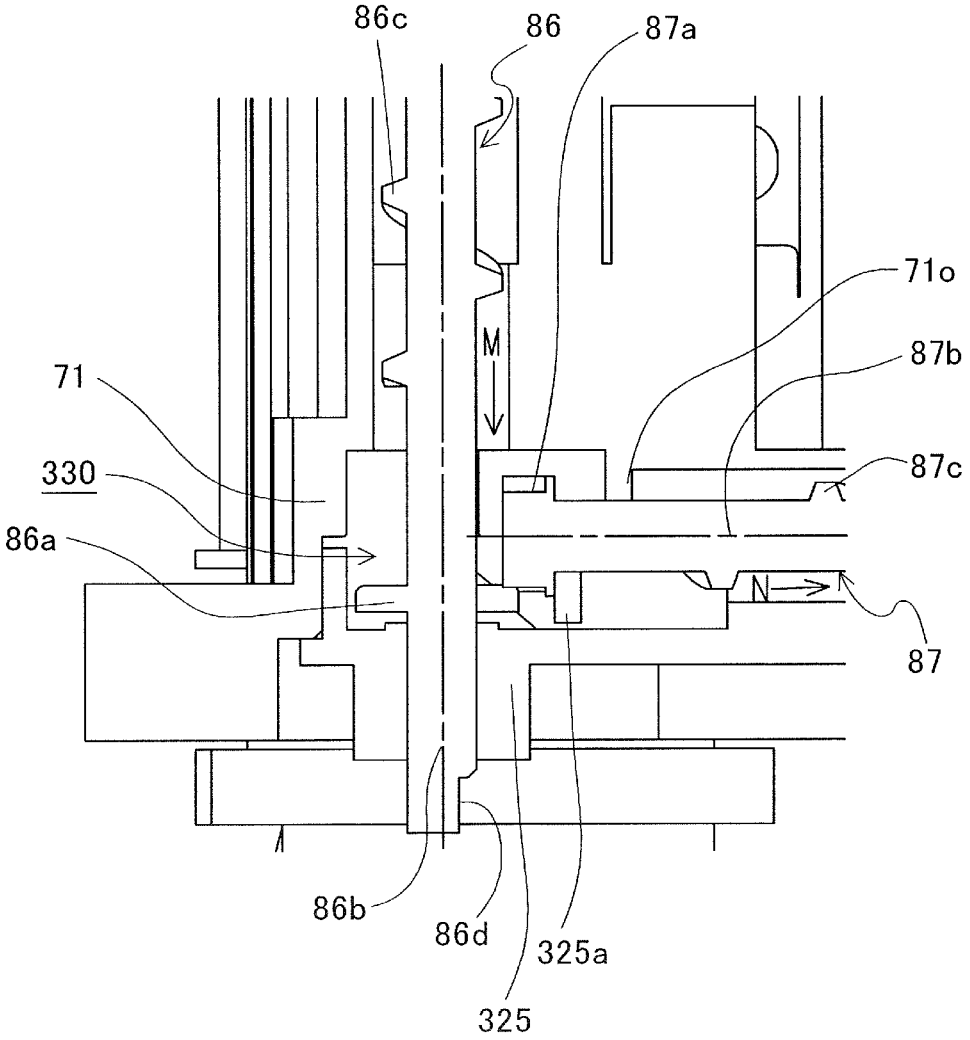
FIG. 36 is a cross-sectional view of a waste toner path according to the third embodiment.

Now, conveyance of waste toner by the first screw 86 and the second screw 87 will be described with reference to FIG. 36. FIG. 36 is a cross-sectional view of a waste toner path 330 provided on the photoconductor cartridge B.

The photoconductor cartridge B includes a cleaning frame member 71 and a screw lid 325. The cleaning frame member 71 and the screw lid 325 form a waste toner path 330 through which waste toner removed from the photosensitive drum 62 passes. The first screw 86 and the second screw 87 are arranged on the waste toner path 330.

An end portion of the first screw 86 protrudes out of the waste toner path 330 through a hole formed on the screw lid 325. A D-cut plane 86*d* is formed at an end portion of the first screw. The first screw gear 323 is attached to the D-cut plane 86*d*. A sponge-like sealing member (not shown) is arranged at a gap formed between the first screw 86 and the hole on the screw lid 325, preventing leakage of toner from the waste toner path 330.

The first screw 86 includes a transmission portion 86*a*. The second screw 87 includes a transmitted portion 87*a*. The transmission portion 86*a* and the transmitted portion 87*a* are engaged at an inner side of the waste toner path 330. In a state where the first screw 86 rotates, the transmission portion 86*a* rotates the transmitted portion 87*a*. Thereby, driving force is transmitted from the first screw 86 to the second screw 87. The transmission portion 86*a* and the transmitted portion 87*a* can be formed, for example, by a pin gear or a bevel gear.

As illustrated in FIG. 36, the first screw 86 includes a shaft portion and a spiral conveyance portion 86*c* that is wound around the shaft portion. Waste toner removed from the photosensitive drum 62 by the cleaning member 77 is conveyed through the conveyance portion 86*c* to an arrow M direction along a direction of a rotational axis 86*b* by the first screw 86 rotating around the rotational axis 86*b*. Further, the transmission portion 86*a* transmits drive to the second screw 87 while transmitting waste toner to the second screw 87.

Meanwhile, the second screw 87 includes a shaft portion and a spiral conveyance portion 87*c* wound around the shaft portion. The cleaning frame member 71 includes a bearing 71*o*, and the screw lid 325 includes a bearing 325*a*. The position of the second screw 87 in a direction orthogonal to a rotational axis 87*b* is regulated by the bearing 710 and the bearing 325*a*. By rotation of the second screw 87 around the rotational axis 87*b*, the waste toner transmitted to the second screw 87 is conveyed in an arrow N direction along the rotational axis 87*b* through the conveyance portion 87*c*. The waste toner conveyed by the second screw 87 is discharged through the waste toner discharge port 72*a* provided on the lid member 72 (refer to FIGS. 26 and 27).

Transmission of Drive from Developing Cartridge to Photoconductor Cartridge

According to the configuration described above, in a configuration where the photoconductor cartridge B is separable from the developing cartridge C, drive can be transmitted from the developing cartridge C to the photoconductor cartridge B, to thereby drive the driven gear 321, the first screw 86 and the second screw 87.

Thereby, force necessary for driving the drum coupling 70 can be reduced.

Further, in the photoconductor cartridge B, there is no need to provide members for transmitting driving force from the drum coupling 70 to the driven gear 321 or the first screw 86 and the second screw 87.

Generally, the number of recording media that can be printed using the photoconductor cartridge B is greater than the number of recording media that can be printed using the developing cartridge C. In the present embodiment, the number of recording media that can be printed by the photoconductor cartridge B is several times the number of recording media that can be printed by the developing cartridge C. In other words, the photoconductor cartridge B can be used longer than the developing cartridge C. That is, a frequency of replacement of the developing cartridge C is higher than a frequency of replacement of the photoconductor cartridge B.

The developing cartridge C must be replaced with a new developing cartridge C when toner is consumed. In contrast, the photoconductor cartridge B can be used until service life of one of the components of the photoconductor cartridge B, such as the photosensitive drum 62 or the charging roller 66, is consumed. In order to increase toner T stored in the developing cartridge C, the size of the developing cartridge must be increased. Meanwhile, service life of the photosensitive drum 62 or the charging roller 66 can be extended by varying materials and so on, without having to increase the size of the photoconductor cartridge B. Further, as described earlier, the photoconductor cartridge B can be used for a longer period of time by collecting waste toner when replacing the developing cartridge C by providing the waste toner chamber 30 in the developing cartridge C.

Meanwhile, the photosensitive drum 62 is designed to contact the recording medium. Therefore, the first screw 86 and the second screw 87 rotate while being in contact with waste toner and paper dusts. Generally, in a state where waste toner and paper dusts exist, wear of the sliding portions between members or at the sealing portion tends to increase. Therefore, if the photoconductor cartridge B having an especially long service life is adopted, it is preferable to reduce the rotation of the first screw 86 or the second screw 87, which are examples of the waste toner conveyance members.

In some cases, the photosensitive drum 62 is rotated to charge the photosensitive drum 62 before the developing roller 32 is rotated. According to the present embodiment, even if the photosensitive drum 62 is rotated before the developing roller 32 is rotated, it becomes possible to prevent the waste toner conveyance member from rotating.

Furthermore, as described earlier, a shutter is respectively provided on the waste toner discharge port 72*a* of the photoconductor cartridge B and the waste toner receiving port 23*d* of the developing cartridge C. In a state where the photoconductor cartridge B and the developing cartridge C are separated, the shutters are respectively closed to prevent waste toner from leaking.

If rotation of the first screw 86 and the second screw 87 is allowed in a state where only the photoconductor cartridge B is attached to the apparatus body A, waste toner is conveyed to the waste toner discharge port 72*a* in a state where the waste toner discharge port 72*a* is closed by the shutter. However, according to the present embodiment, the first screw 86 and the second screw 87 are rotated by the driving force from the developing cartridge C. Therefore, the first screw 86 and the second screw 87 are not driven unless the photoconductor cartridge B and the developing cartridge C are coupled. Therefore, waste toner can be conveyed to the waste toner discharge port 72*a* in a state where the waste toner discharge port 72*a* is opened without fail.

Modified Examples

In the third embodiment described above, a gear meshed directly with each other was described as an example of the drive transmission portion and the driven portion, but other drive transmission mechanisms can be used. For example, a dog clutch mutually meshed with one another can be adopted as the drive transmission portion and the driven portion.

According to the third embodiment, the first screw 86 for conveying waste toner was illustrated as an example of a member in the first cartridge, that is, the photoconductor cartridge B, driven by driving force transmitted to the first cartridge via the second cartridge, that is, the developing cartridge C. However, another member, such as the charging roller 66 of FIG. 2, of the photoconductor cartridge B can rotate by the driving force transmitted via the developing cartridge C.

Other Embodiments

Embodiments described according to the aforementioned embodiments were mere examples for carrying out the present invention, and other modifications are possible within the scope of the technical ideas of the present technique. For example, the image forming unit may include a cartridge other than the photoconductor cartridge B and the developing cartridge C, such as a toner cartridge capable of being detachably attached to the developing cartridge C.

Further, the coupling pin 69 and the first and second support holes 23*a* and 23*b* are mere examples of the engagement portion and the engaged portions. Instead of the configuration of the above-illustrated embodiments, for example, a shaft-like member can be provided in the developing cartridge C, and a trench-shaped portion that is engaged with the shaft-like member can be provided in the photoconductor cartridge B. According to the first and second embodiments, the coupling pins 69 and 69 are arranged on both end portions in the reference axis direction X of the photoconductor cartridge B, and the first and second support holes 23*a* and 23*b* are arranged on both end portions in the reference axis direction X of the developing cartridge C, but the arrangement of the present invention is not limited thereto. The configuration can include one set of engagement portion and engaged portion, or more than three sets. However, the position or positions at which the engagement portion(s) and the engaged portion(s) engage should preferably be arranged symmetrically with respect to the reference axis direction X.

According to the present embodiment, driving force can be transmitted from the second cartridge to the first cartridge in the image forming unit in which the second cartridge is arranged detachably from the first cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-032129, filed on Feb. 25, 2019, and 2019-189732, filed on Oct. 16, 2019, which are hereby incorporated by reference herein in their entirety.

What is claimed is:

1. A cartridge to be attached to and detached from an apparatus body of an image forming apparatus, the cartridge comprising:

a first unit including:

(i) a first driven portion configured to be driven by a first driving member that is provided in the apparatus body, the first driven portion being arranged to be adjacent to the first driving member in a rotational axis direction of the first driven portion in a state where the first unit is attached to the apparatus body; and (ii) a second driven portion configured to be driven by a second driving member provided in a second unit that can be attached to and detached from the apparatus body in the state where the first unit is attached to the apparatus body, the second driven portion being configured to directly engage with the second driving member, and the second driven portion being arranged to be adjacent to the second driving member in a direction orthogonal to a rotational axis direction of the second driven portion in the state where the first unit is attached to the apparatus body.

2. The cartridge according to claim 1, further comprising an image bearing member configured to rotate.

3. The cartridge according to claim 2, wherein the first driven portion is disposed on a rotational axis of the image bearing member.

4. The cartridge according to claim 2, further comprising:

a cleaning member configured to remove waste toner from the image bearing member; and a conveyance member configured to convey the waste toner removed from the image bearing member.

5. The cartridge according to claim 4, wherein the conveyance member is configured to be driven by a driving force transmitted through the second driven portion.

6. The cartridge according to claim 4, wherein the cartridge is provided with an opening through which the waste toner is discharged out of the cartridge.

7. The cartridge according to claim 1, wherein the second driven portion is positioned upstream of the first driven portion in an insertion direction of the cartridge to the apparatus body of the image forming apparatus.

8. The cartridge according to claim 1, wherein an insertion direction of the cartridge to the apparatus body of the image forming apparatus is a direction orthogonal to the rotational axis direction of the first driven portion.

9. The cartridge according to claim 1, wherein an insertion direction of the cartridge to the apparatus body of the image forming apparatus is a direction orthogonal to the rotational axis direction of the second driven portion.

10. The cartridge according to claim 1, wherein the first driving member is a shaft member, and the first driven portion is a shaft coupling configured to engage with the shaft member.

11. The cartridge according to claim 1, wherein the second driving member and the second driven portion are gears configured to be meshed with each other.

12. An image forming apparatus comprising:

an apparatus body; and the cartridge according to claim 1 configured to be attached to and detached from the apparatus body.

13. The cartridge according to claim 1, wherein the first unit includes a first portion to which the second unit is detachably attached.

* * * * *